US012037733B2

(12) United States Patent
Kim et al.

(10) Patent No.: US 12,037,733 B2
(45) Date of Patent: Jul. 16, 2024

(54) LAUNDRY TREATING APPARATUS

(71) Applicant: LG Electronics Inc., Seoul (KR)

(72) Inventors: Dongcheol Kim, Seoul (KR); Youngjong Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 99 days.

(21) Appl. No.: 17/402,167

(22) Filed: Aug. 13, 2021

(65) Prior Publication Data

US 2022/0049408 A1 Feb. 17, 2022

(30) Foreign Application Priority Data

Aug. 14, 2020 (KR) ..... 10-2020-0102586

(51) Int. Cl.

| | |
|---|---|
| ***D06F 37/12*** | (2006.01) |
| ***D06F 13/02*** | (2006.01) |
| ***D06F 17/10*** | (2006.01) |
| ***D06F 37/40*** | (2006.01) |

(52) U.S. Cl.

CPC ..... *D06F 37/40* (2013.01); *D06F 13/02* (2013.01); *D06F 17/10* (2013.01); *D06F 37/12* (2013.01)

(58) Field of Classification Search

CPC ..... D06F 13/00; D06F 13/02; D06F 13/06; D06F 17/06; D06F 17/10; D06F 21/00; D06F 21/06; D06F 21/08; D06F 23/00; D06F 23/04; D06F 37/12; D06F 37/40; D06F 39/024

See application file for complete search history.

(56) References Cited

U.S. PATENT DOCUMENTS

| | | | | | |
|---|---|---|---|---|---|
| 2,034,527 | A * | 3/1936 | Nelson | D06F 13/00 | 68/133 |
| 3,987,508 | A * | 10/1976 | Platt | D06F 13/00 | 8/159 |
| 5,167,722 | A * | 12/1992 | Pastryk | D06F 35/006 | 68/23.5 |
| 2004/0016267 | A1* | 1/2004 | Clark | D06F 13/02 | 68/133 |
| 2005/0284197 | A1* | 12/2005 | Pinkowski | D06F 13/02 | 68/133 |
| 2014/0096568 | A1* | 4/2014 | Carr | D06F 23/04 | 68/131 |

* cited by examiner

*Primary Examiner* — David G Cormier
(74) *Attorney, Agent, or Firm* — Fish & Richardson P.C.

(57) ABSTRACT

A laundry treating apparatus includes a tub, a drum, and a rotator. The rotator includes a bottom portion positioned on a bottom surface, a pillar protruding from the bottom portion toward an open surface, and a blade protruding from an outer circumferential surface of the pillar, wherein the blade extends from one end facing toward the bottom portion to the other end facing toward the open surface. The blade extends obliquely with respect to a longitudinal direction of the pillar, and the number of turns of the blade wound on the pillar from said one end to the other end is equal to higher than 0.4 and equal to or lower than 0.6 when viewed from the open surface.

20 Claims, 32 Drawing Sheets

LAUNDRY TREATING APPARATUS

CROSS-REFERENCE TO RELATED APPLICATIONS

This application claims the benefit of Korean Patent Application No. 10-2020-0102586, filed on Aug. 14, 2020, which is hereby incorporated by reference as if fully set forth herein.

TECHNICAL FIELD

The present disclosure relates to a laundry treating apparatus, and more particularly, to a laundry treating apparatus having a rotator disposed in a drum.

BACKGROUND

A laundry treating apparatus is an apparatus that puts clothes, bedding, and the like (hereinafter, referred to as laundry) into a drum to remove contamination from the laundry. The laundry treating apparatus may perform processes such as washing, rinsing, dehydration, drying, and the like. The laundry treating apparatuses may be classified into a top loading type laundry treating apparatus and a front loading type laundry treating apparatus based on a scheme of putting the laundry into the drum.

The laundry treating apparatus may include a housing forming an appearance of the laundry treating apparatus, a tub accommodated in the housing, a drum that is rotatably mounted inside the tub and into which the laundry is put, and a detergent feeder that feeds detergent into the drum.

When the drum is rotated by a motor while wash water is supplied to the laundry accommodated in the drum, dirt on the laundry may be removed by friction with the drum and the wash water.

In one example, a rotator may be disposed inside the drum to improve a laundry washing effect. The rotator may be rotated inside the drum to form a water flow, and the laundry washing effect may be improved by the rotator.

Specifically, the rotator may include a pillar extending in a direction parallel to a rotation shaft of the drum, and a blade that forms a water flow when the pillar rotates may be disposed on an outer circumferential surface of the pillar.

With respect to the rotator, U.S. Pat. No. 941,741 discloses a rotator including a pillar having a blade formed thereon. The blade of the rotator extends in a curved form in some sections, and extends parallel to a longitudinal direction of the pillar in the remaining sections.

The rotator disclosed in U.S. Pat. No. 941,741 may be disadvantageous in terms of molding because the blade has a curved shape with an inclination angle varying in some sections, and may be disadvantageous in improving a washing efficiency because the blade extends parallel to the longitudinal direction of the pillar in the remaining section.

In addition, U.S. patent Ser. No. 15/067,294 discloses a rotator including vanes inclined with respect to the longitudinal direction of the pillar. A plurality of vanes are disposed along a longitudinal direction of the pillar, and have opposite inclination angles.

Because the rotator disclosed in U.S. patent Ser. No. 15/067,294 has the plurality of vanes having the different inclination angles from each other, ascending or descending of the water flow is difficult to occur when the rotator rotates, so that it may be disadvantageous in improving the washing efficiency through formation of a three-dimensional water flow.

In addition, U.S. Pat. No. 839,997 discloses a rotator including a blade extending in a zigzag form in some sections and extending in parallel with the longitudinal direction of a pillar in the remaining sections.

In the rotator of U.S. Pat. No. 839,997, because the blade extends in the zigzag form in some sections, it is difficult to generate one of the ascending water flow or the descending water flow during the rotation, which may be disadvantageous in improving the washing efficiency through the formation of the three-dimensional water flow.

In the laundry treating apparatus including the rotator that forms the water flow, it is an important task in the art to provide a rotator that is designed to be advantageous to the formation of the three-dimensional water flow when the rotator is rotated, which is advantageous to improve the washing efficiency with various rotation strategies, and that is efficient in forming the three-dimensional water flow, effectively reduces a load resulted from the rotation, and effectively secures a mechanical strength.

SUMMARY

Embodiments of the present disclosure are intended to provide a laundry treating apparatus including a rotator that forms a water flow that may effectively improve a washing efficiency.

In addition, embodiments of the present disclosure are intended to provide a laundry treating apparatus that is efficiently designed to effectively improve space utilization and washing efficiency.

In one embodiment of the present disclosure, a rotator may include a pillar, that is, an agitator, and a blade disposed on the pillar may be wound around the pillar. One embodiment of the present disclosure may improve an effect of generating a water flow by applying the number of turns that the blade is wound around the pillar equal to or lower than 1.

In a case of the blade with the number of turns equal to or lower than 1, because a vertical movement distance per rotation of the pillar is large when the pillar rotates, an ascending water flow and a descending water flow may be formed only by a difference in an amount of rotation between a rotation in one direction and a rotation in the other direction of the pillar, and ascending and descending of laundry may be induced.

One embodiment of the present disclosure minimizes a water flow resistance that the pillar receives during the rotation by applying a large curvature R value to a connection portion of the pillar and the blade. This may improve a shaft overload and improve a washing performance.

When the rotator includes the pillar equipped with the blade, it may be advantageous to exhibit high washing performance by the blade in a heavy load condition of the laundry. However, under a small load condition, the blade may not contribute to the formation of the water flow, which may be relatively disadvantageous.

In one embodiment of the present disclosure, both a protrusion of a bottom portion and the blade of the pillar may be in contact with water and the laundry even under the small load condition, so that optimum washing performance may be secured even under the small load condition.

A laundry treating apparatus according to an embodiment of the present disclosure as described above may include a tub, a drum, and a rotator. The tub may provide therein a space for water to be stored, the drum may be rotatably disposed inside the tub, and include an open surface for inserting and withdrawing laundry therethrough and a bottom surface located on an opposite side of the open surface, and the rotator may be rotatably disposed on the bottom surface and inside the drum.

The rotator may include a bottom portion positioned on the bottom surface, a pillar protruding from the bottom portion toward the open surface, and a blade protruding from an outer circumferential surface of the pillar, wherein the blade extends from one end facing toward the bottom portion to the other end facing toward the open surface.

The blade may extend obliquely with respect to a longitudinal direction of the pillar, and the number of turns of the blade wound on the pillar from said one end to the other end may be equal to higher than 0.4 and equal to or lower than 0.6 when viewed from the open surface.

The blade may continuously extend obliquely with respect to the longitudinal direction of the pillar from said one end to the other end. The blade may extend with a constant inclination angle with respect to a circumferential direction of the pillar.

The blade may have the inclination angle equal to or greater than 35 degrees and equal to or smaller than 65 degrees. A height from said one end to the other end of the blade may be equal to or greater than 0.5 times the total height of the pillar in the longitudinal direction of the pillar.

An extension length of the blade from said one end to the other end along an extension direction may be equal to or greater than 1.4 times and equal to or less than 1.8 times of a height of the blade from said one end to the other end based on the longitudinal direction of the pillar.

The pillar may be formed in a hollow shape, an opening in communication with an interior may be defined at an end of the pillar facing toward the open surface, and the laundry treating apparatus may include a cap coupled to the end of the pillar to close the opening.

The other end of the blade may be positioned spaced apart from the cap with respect to the longitudinal direction of the pillar.

A spaced distance between the other end of the blade and the cap may be smaller than a length of the cap.

The pillar may further include a cap-coupled-portion coupled to the cap, and a spaced distance between the other end of the blade and the cap may be equal to or greater than twice the deviation amount between a thickness of the pillar and a thickness of the blade at the cap-coupled-portion.

A diameter of the bottom portion may be equal to or greater than 0.7 times and equal to or less than 0.9 times the diameter of the drum. A length of the pillar may be equal to or greater than 0.8 times and equal to or less than 1.2 times the diameter of the bottom portion.

The rotator may further include a protrusion including a plurality of protrusions disposed to be spaced apart from each other along a circumferential direction of the bottom portion, wherein the protrusion protrudes from the bottom portion to the open surface, and wherein the protrusion extends in a direction to be away from the pillar.

The protrusion may include a main protrusion having an inner end facing toward the pillar connected to the pillar, and said one end of the blade may be spaced apart from the inner end of the main protrusion with respect to the longitudinal direction of the pillar.

The blade may extend from said one end to the other end while being inclined in one of circumferential directions of the pillar with respect to the longitudinal direction of the pillar, and said one end of the blade may be disposed at a position spaced apart from the main protrusion in said one direction.

Said one end of the blade may have a spaced distance from the main protrusion along the longitudinal direction of the pillar greater than a spaced distance from the main protrusion along said one direction.

The blade may have one surface at least partially facing toward the open surface, and the other surface disposed on an opposite side of said one surface and at least partially facing toward the bottom portion, and said one surface may be connected to the outer circumferential surface of the pillar while forming an obtuse angle thereto, and the other surface may be connected to the outer circumferential surface of the pillar while forming an acute angle thereto.

Embodiments of the present disclosure may provide the laundry treating apparatus including the rotator that forms the water flow that may effectively improve the washing efficiency.

In addition, embodiments of the present disclosure may provide the laundry treating apparatus that is efficiently designed to effectively improve the space utilization and the washing efficiency.

DETAILED DESCRIPTION

Figure 1:
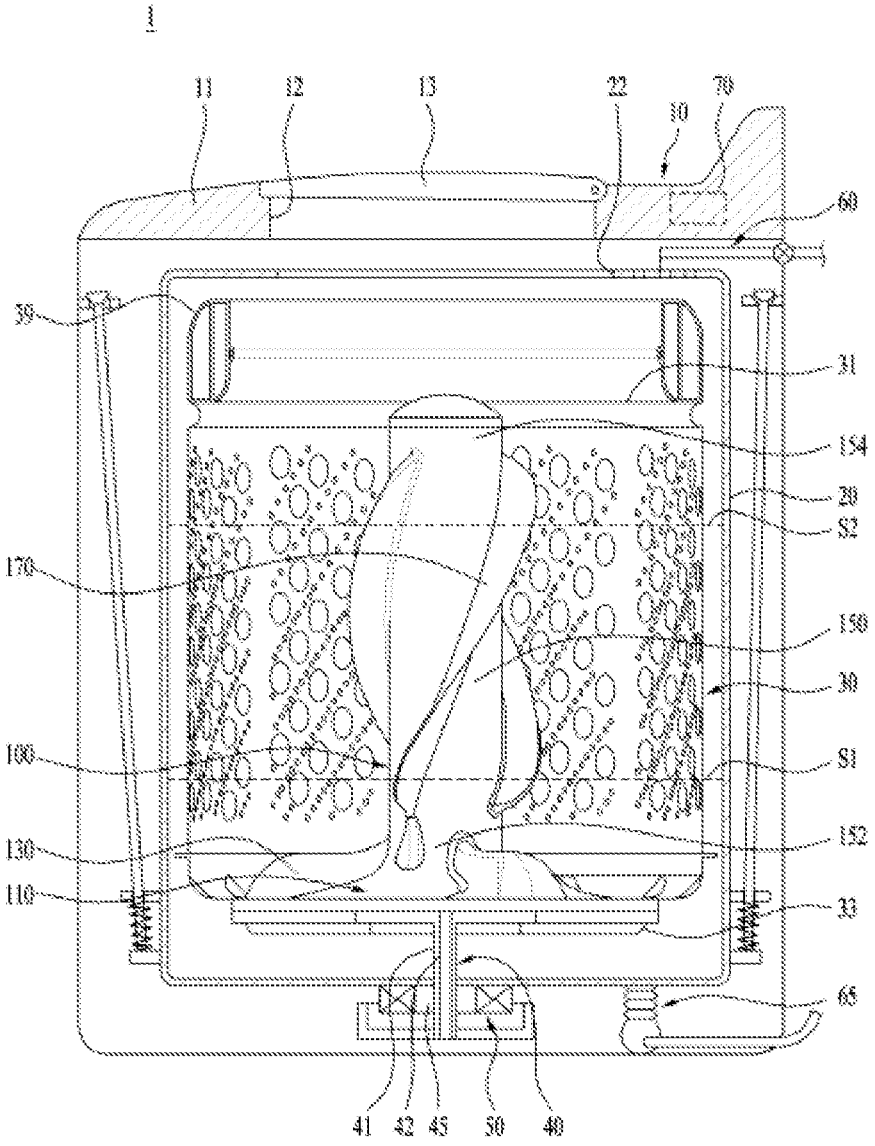
FIG. 1 is a view showing an interior of a laundry treating apparatus according to an embodiment of the present disclosure.

Hereinafter, an embodiment of the present disclosure will be described in detail with reference to the accompanying drawings such that a person having ordinary knowledge in the technical field to which the present disclosure belongs may easily implement the embodiment.

However, the present disclosure is able to be implemented in various different forms and is not limited to the embodiment described herein. In addition, in order to clearly describe the present disclosure, components irrelevant to the description are omitted in the drawings. Further, similar reference numerals are assigned to similar components throughout the specification.

Duplicate descriptions of the same components are omitted herein.

In addition, it will be understood that when a component is referred to as being 'connected to' or 'coupled to' another component herein, it may be directly connected to or coupled to the other component, or one or more intervening components may be present. On the other hand, it will be understood that when a component is referred to as being 'directly connected to' or 'directly coupled to' another component herein, there are no other intervening components.

The terminology used in the detailed description is for the purpose of describing the embodiments of the present disclosure only and is not intended to be limiting of the present disclosure.

As used herein, the singular forms 'a' and 'an' are intended to include the plural forms as well, unless the context clearly indicates otherwise.

It should be understood that the terms 'comprises', 'comprising', 'includes', and 'including' when used herein, specify the presence of the features, numbers, steps, operations, components, parts, or combinations thereof described herein, but do not preclude the presence or addition of one or more other features, numbers, steps, operations, components, or combinations thereof.

In addition, in this specification, the term 'and/or' includes a combination of a plurality of listed items or any of the plurality of listed items. In the present specification, 'A or B' may include 'A', 'B', or 'both A and B'.

FIG. 1 shows an interior of a laundry treating apparatus 1 according to an embodiment of the present disclosure. The laundry treating apparatus 1 may include a cabinet 10, a tub 20, and a drum 30.

The cabinet 10 may be in any shape as long as being able to accommodate the tub 20, and FIG. 1 shows a case in which the cabinet 10 forms an appearance of the laundry treating apparatus 1 as an example.

The cabinet 10 may have a laundry inlet 12 defined therein for putting laundry into the drum 30 or withdrawing the laundry stored in the drum 30 to the outside, and may have a laundry door 13 for opening and closing the laundry inlet 12.

FIG. 1 shows that a laundry inlet 12 is defined in a top surface 11 of a cabinet 10, and a laundry door 13 for opening and closing the laundry inlet 12 is disposed on the top surface 11 according to an embodiment of the present disclosure. However, the laundry inlet 12 and the laundry door 13 are not necessarily limited to being defined in and disposed on the top surface 11 of the cabinet 10.

A tub 20 is means for storing water necessary for washing laundry. The tub 20 may have a tub opening 22 defined therein in communication with the laundry inlet 12. For example, one surface of the tub 20 may be opened to define the tub opening 22. At least a portion of the tub opening 22 may be positioned to face the laundry inlet 12, so that the tub opening 22 may be in communication with the laundry inlet 12.

FIG. 1 shows a top loading type laundry treating apparatus 1 according to an embodiment of the present disclosure. Therefore, FIG. 1 shows that a top surface of the tub 20 is opened to define the tub opening 22, and the tub opening 22 is positioned below the laundry inlet 12 and in communication with the laundry inlet 12.

The tub 20 is fixed at a location inside the cabinet 10 through a support of the tub 20. The support of the tub 20 may be in a structure capable of damping vibrations generated in the tub 20.

The tub 20 is supplied with water through a water supply 60. The water supply 60 may be composed of a water supply pipe that connects a water supply source with the tub 20, and a valve that opens and closes the water supply pipe.

The laundry treating apparatus 1 according to an embodiment of the present disclosure may include a detergent feeder that stores detergent therein and is able to supply the detergent into the tub 20. As the water supply 60 supplies water to the detergent feeder, the water that has passed through the detergent feeder may be supplied to the tub 20 together with the detergent.

In addition, the laundry treating apparatus 1 according to an embodiment of the present disclosure may include a water sprayer that sprays water into the tub 20 through the tub opening 22. The water supply 60 may be connected to the water sprayer to supply water directly into the tub 20 through the water sprayer.

The water stored in the tub 20 is discharged to the outside of the cabinet 10 through a drain 65. The drain 65 may be composed of a drain pipe that guides the water inside the tub 20 to the outside of the cabinet 10, a drain pump disposed on the drain pipe, and a drain valve for controlling opening and closing of the drain pipe.

The drum 30 may be rotatably disposed inside the tub 20. The drum 30 may be constructed to have a circular cross-section in order to be rotatable inside the tub 20. For example, the drum 30 may be in a cylindrical shape as shown in FIG. 1.

The drum 30 may have a drum opening defined therein positioned below the tub opening 22 to communicate with the inlet. One surface of the drum 30 may be opened to define an open surface 31 as will be described later, and the open surface 31 may correspond to the drum opening.

A plurality of drum through-holes that communicate an interior and an exterior of the drum 30 with each other, that is, the interior of the drum 30 and an interior of the tub 20 divided by the drum 30 with each other may be defined in an outer circumferential surface of the drum 30. Accordingly, the water supplied into the tub 20 may be supplied to the interior of the drum 30 in which the laundry is stored through the drum through-holes.

The drum 30 may be rotated by a driver 50. The driver 50 may be composed of a stator fixed at a location outside the tub 20 and forming a rotating magnetic field when a current is supplied, a rotor rotated by the rotating magnetic field, and a rotation shaft 40 disposed to penetrate the tub 20 to connect the drum 30 and the like to the rotor.

As shown in FIG. 1, the rotation shaft 40 may be disposed to form a right angle with respect to a bottom surface 33 of the tub 20. In this case, the laundry inlet 12 may be defined in the top surface 11 of the cabinet 10, the tub opening 22 may be defined in the top surface of the tub 20, and the drum opening may be defined in the top surface of the drum 30.

In one example, when the drum 30 rotates in a state in which the laundry is concentrated in a certain region inside the drum 30, a dynamic unbalance state (an unbalanced state) occurs in the drum 30. When the drum 30 in the unbalanced state rotates, the drum 30 rotates while vibrating by a centrifugal force acting on the laundry. The vibration of the drum 30 may be transmitted to the tub 20 or the cabinet 10 to cause a noise.

To avoid problems like this, the present disclosure may further include a balancer 39 that controls the unbalance of the drum 30 by generating a force to offset or damp the centrifugal force acting on the laundry.

In one example, referring to FIG. 1, the tub 20 may have a space defined therein in which the water may be stored, and the drum 30 may be rotatably disposed inside the tub 20. The drum 30 may include the open surface 31 through which the laundry enters and exits, and a bottom surface 33 positioned on an opposite side of the open surface 31.

FIG. 1 shows that the top surface of the drum 30 corresponds to the open surface 31, and the bottom surface thereof corresponds to the bottom surface 33 according to an embodiment of the present disclosure. As described above, the open surface 31 may correspond to a surface through which the laundry input through the laundry inlet 12 of the cabinet 10 and the tub opening 22 of the tub 20 passes.

In one example, the water supply 60 may be constructed to be connected to the means such as the detergent feeder, the water sprayer, or the like to supply the water into the tub 20 as described above. In one example, an embodiment of the present disclosure may include a controller 70 that controls the water supply 60 to adjust a water supply amount in a washing process and the like.

The controller 70 is configured to adjust the amount of water supplied to the tub 20 in the washing process, a rinsing process, or the like. The amount of water supplied may be adjusted through a manipulation unit disposed on the cabinet 10 and manipulated by a user, or may be determined through an amount of laundry, a load of the driver 50, or the like.

A plurality of water supply amounts are preset in the controller 70, and the controller 70 may be configured to control the water supply 60 based on one of the preset water supply amounts in response to a command selected by a user or the like in the washing process or the like.

In one example, as shown in FIG. 1, an embodiment of the present disclosure may further include a rotator 100. The rotator 100 may be rotatably installed on the bottom surface 33 and inside the drum 30.

In one embodiment of the present disclosure, the drum 30 and the rotator 100 may be constructed to be rotatable, independently. A water flow may be formed by the rotation of the drum 30 and the rotator 100, and friction or collision with the laundry may occur, so that washing or rinsing of the laundry may be made.

Figure 2:
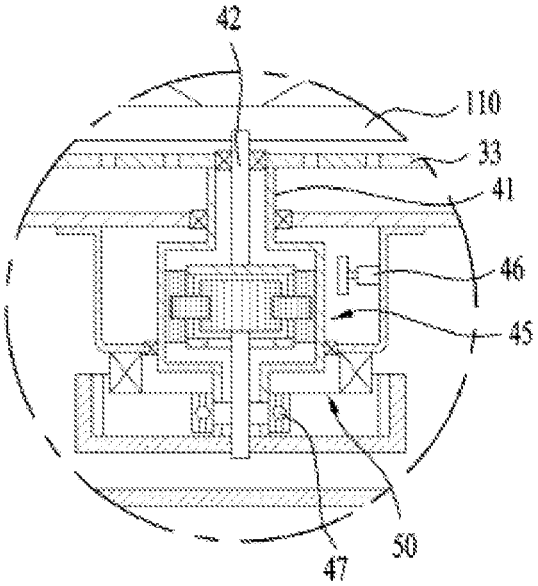
FIG. 2 is a view showing a rotation shaft coupled to a drum and a rotator in a laundry treating apparatus according to an embodiment of the present disclosure.

In one example, FIG. 2 shows the rotation shaft 40 coupled with the drum 30 and the rotator 100 according to an embodiment of the present disclosure.

Each of the drum 30 and the rotator 100 may be connected to the driver 50 through the rotation shaft 40 to receive a rotational force. In one embodiment of the present disclosure, the drum 30 may be rotated as a first rotation shaft 41 is coupled to the bottom surface 33 thereof, and the rotator 100 may be rotated by being coupled to a second rotation shaft 42 that passes through the bottom surface 33 and separately rotated with respect to the first rotation shaft 41.

The second rotation shaft 42 may rotate in a direction the same as or opposite to a rotation direction of the first rotation shaft 41. The first rotation shaft 41 and the second rotation shaft 42 may receive power through one driver 50, and the driver 50 may be connected to a gear set 45 that distributes the power to the first rotation shaft 41 and the second rotation shaft 42 and adjusts the rotation direction.

That is, a driving shaft of the driver 50 may be connected to the gear set 45 to transmit the power to the gear set 45, and each of the first rotation shaft 41 and the second rotation shaft 42 may be connected to the gear set 45 to receive the power.

The first rotation shaft 41 may be constructed as a hollow shaft, and the second rotation shaft 42 may be constructed as a solid shaft disposed inside the first rotation shaft 41. Accordingly, one embodiment of the present disclosure may effectively provide the power to the first rotation shaft 41 and the second rotation shaft 42 parallel to each other through the single driver 50.

FIG. 2 shows a planetary gear-type gear set 45, and shows a state in which each of the driving shaft, the first rotation shaft 41, and the second rotation shaft 42 is coupled to the gear set 45. Referring to FIG. 2, a rotational relationship of the first rotation shaft 41 and the second rotation shaft 42 in one embodiment of the present disclosure will be described as follows.

The driving shaft of the driver 50 may be connected to a central sun gear in the planetary gear-type gear set 45. When the driving shaft is rotated, a satellite gear and a ring gear in the gear set 45 may rotate together by the rotation of the sun gear.

The first rotation shaft 41 coupled to the bottom surface 33 of the drum 30 may be connected to the ring gear positioned at the outermost portion of the gear set 45. The second rotation shaft 42 coupled to the rotator 100 may be connected to the satellite gear disposed between the sun gear and the ring gear in the gear set 45.

In one example, the gear set 45 may include a first clutch element 46 and a second clutch element 47 that may restrict the rotation of each of the rotation shafts 40 as needed. The gear set 45 may further include a gear housing fixed to the tub 20, and the first clutch element 46 may be disposed in the gear housing to selectively restrict the rotation of the first rotation shaft 41 connected to the ring gear.

The second clutch element 47 may be constructed to mutually restrict or release the rotations of the driving shaft and the ring gear. That is, the rotation of the ring gear or the rotation of the first rotation shaft 41 may be synchronized with or desynchronized with the driving shaft by the second clutch element 47.

In one embodiment of the present disclosure, when the first clutch element 46 and the second clutch element 47 are in the releasing state, the first rotation shaft 41 and the second rotation shaft 42 rotate in the opposite directions based on the rotational relationship of the planetary gear. That is, the drum 30 and the rotator 100 rotate in the opposite directions.

In one example, when the first clutch element 46 is in the restricting state, the rotations of the ring gear and the first rotation shaft 41 are restricted, and the rotation of the second rotation shaft 42 is performed. That is, the drum 30 is in a stationary state and only the rotator 100 rotates. In this connection, the rotation direction of the rotator 100 may be determined based on the rotation direction of the driver 50.

In one example, when the second clutch element 47 is in the restricting state, the rotations of the driving shaft and the first rotation shaft 41 are mutually restricted to each other, and the rotations of the driving shaft, the first rotation shaft 41, and the second rotation shaft 42 may be mutually restricted to each other by the rotational relationship of the planetary gear. That is, the drum 30 and the rotator 100 rotate in the same direction.

When the first clutch element 46 and the second clutch element 47 are in the restricting state at the same time, the driving shaft, the first rotation shaft 41, and the second rotation shaft 42 are all in the stationary state. The controller 70 may implement a necessary driving state by appropriately controlling the driver 50, the first clutch element 46, the second clutch element 47, and the like in the washing process, the rinsing process, and the like.

Figure 3:
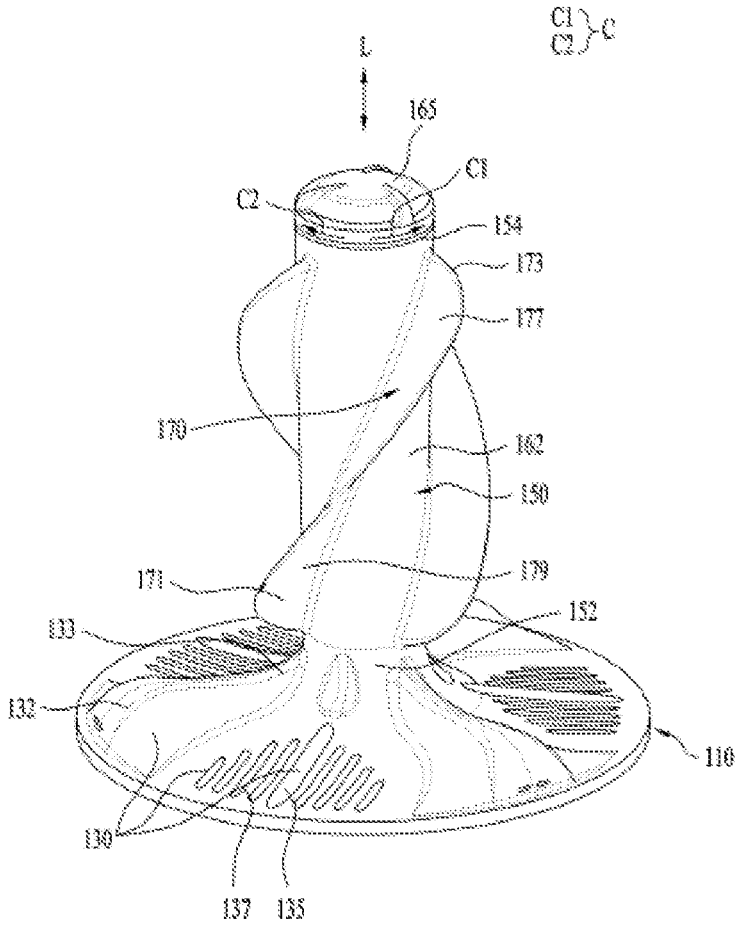
FIG. 3 is a perspective view illustrating a rotator of a laundry treating apparatus according to an embodiment of the present disclosure.

In one example, FIG. 3 is a perspective view of the rotator 100 according to an embodiment of the present disclosure. In one embodiment of the present disclosure, the rotator 100 may include a bottom portion 110, a pillar 150, and a blade 170.

The bottom portion 110 may be located on the bottom surface 33 of the drum 30. The bottom portion 110 may be positioned parallel to the bottom surface 33 of the drum 30 to be rotatable on the bottom surface 33. The second rotation shaft 42 described above may be coupled to the bottom portion 110.

That is, the first rotation shaft 41 may be coupled to the drum 30, and the second rotation shaft 42 constructed as the solid shaft inside the hollow first rotation shaft 41 may penetrate the bottom surface 33 of the drum 30 and be coupled to the bottom portion 110 of the rotator 100.

The rotator 100 coupled to the second rotation shaft 42 may rotate independently with respect to the drum 30. That is, the rotator 100 may be rotated in the direction the same as or opposite to that of the drum 30, and such rotation direction may be selected by the controller 70 or the like when necessary.

The first rotation shaft 41 may be coupled to a center of the bottom surface 33 of the drum 30. FIG. 1 shows that the top surface of the drum 30 is opened to define the open surface 31 according to an embodiment of the present disclosure, and the bottom surface thereof corresponds to the bottom surface 33.

That is, the laundry treating apparatus 1 shown in FIG. 1 corresponds to a top loader. The drum 30 may have a side surface, that is, an outer circumferential surface, that connects the top surface with the bottom surface, and a cross-section of the drum 30 may have a circular shape for balancing the rotation. That is, the drum 30 may have a cylindrical shape.

The second rotation shaft 42 may be coupled to a center of the bottom portion 110 of the rotator 100. The second rotation shaft 42 may be coupled to one surface facing the drum 30, that is, a bottom surface of the bottom portion 110, or the second rotation shaft 42 may pass through a center of the drum 30 to be coupled to the bottom portion 110.

The bottom portion 110 may have a circular cross-section in consideration of balancing of the rotation. The bottom portion 110 may be rotated about the second rotation shaft 42 coupled to the center thereof, and the center of the bottom portion 110 may coincide with the center of the drum 30.

The bottom portion 110 may basically have a disk shape, and a specific shape thereof may be determined in consideration of a connection relationship between a protrusion 130, the pillar 150, and the like as will be described later.

The bottom portion 110 may cover at least a portion of the drum 30. The bottom portion 110 may be constructed such that the bottom surface thereof and the drum 30 are spaced apart from each other to facilitate the rotation. However, a spaced distance between the bottom portion 110 and the bottom surface 33 of the drum 30 may be varied as needed.

In one example, as shown in FIG. 3, the pillar 150 may have a shape protruding from the bottom portion 110 toward the open surface 31. The pillar 150 may be integrally formed with the bottom portion 110 or manufactured separately and coupled to the bottom portion 110.

The pillar 150 may be rotated together with the bottom portion 110. The pillar 150 may extend from the center of the bottom portion 110 toward the open surface 31. FIG. 1 shows the pillar 150 protruding upwardly from the bottom portion 110 according to an embodiment of the present disclosure. The pillar 150 may have a circular cross-section, and a protruding height L1 from the bottom portion 110 may vary.

The pillar 150 may have a curved side surface forming an outer circumferential surface 162, the rotator 100 may include the blade 170, and the blade 170 may be disposed on the outer circumferential surface 162 of the pillar 150.

The blade 170 may be constructed to protrude from the pillar 150, and may extend along the pillar 150 to form the water flow inside the drum 30 when the pillar 150 rotates.

A plurality of blades 170 may be disposed and spaced apart from each other along a circumferential direction C of the pillar 150, and may extend from the bottom portion 110 to the open surface 31 along a direction inclined with respect to a longitudinal direction L of the pillar 150.

Specifically, as shown in FIG. 3, the blade 170 may extend approximately along the longitudinal direction L of the pillar 150. The plurality of blades 170 may be disposed, and the number of blades may vary as needed. FIG. 3 shows a state in which three blades 170 are disposed on the outer circumferential surface 162 of the pillar 150 according to an embodiment of the present disclosure.

The blades 170 may be uniformly disposed along the circumferential direction C of the pillar 150. That is, spaced distances L5 between the blades 170 may be the same. When viewed from the open surface 31 of the drum 30, the blades 170 may be spaced apart from each other at an angle of 120 degrees with respect to a center O of the pillar 150.

The blade 170 may extend along a direction inclined with respect to the longitudinal direction L or the circumferential direction C of the pillar 150. The blade 170 may extend obliquely from the bottom portion 110 to the open surface 31 on the outer circumferential surface 162 of the pillar 150. An extended length L3 of the blade 170 may be varied as needed.

The extended length L3 of the blade 170 means a length of the blade 170 extended along the extension direction thereof from one end of the blade 170 facing toward the bottom portion 110 or from one end 171 to the other end facing toward the open surface or to the other end 173, and is different from the height L2 between said one end and the other end.

As the blade 170 extends obliquely, when the rotator 100 is rotated, an ascending or descending water flow may be formed in the water inside the drum 30 by the blade 170 of the pillar 150.

For example, when the blade 170 extends from the bottom portion 110 toward the open surface 31 while being inclined with respect to one direction C1 among the circumferential directions C of the pillar 150, the descending water flow may be formed by the inclined shape of the blade 170 when the rotator 100 rotates in said one direction C1, and the ascending water flow may be formed by the blade 170 when the rotator 100 is rotated in the other direction C2.

In one embodiment of the present disclosure, said one direction C1 and the other direction C2 of the circumferential direction C of the pillar 150 may correspond to directions opposite to each other with respect to the outer circumferential surface 162 of the pillar 150, and may be a direction perpendicular to the longitudinal direction L of the pillar 150.

Said one direction C1 and the other direction C2 of the circumferential direction C of the pillar 150 may correspond to the rotation direction of the rotator 100. Because the rotation direction of the rotator 100 and the circumferential direction C of the pillar 150 are parallel to each other, the rotator 100 may be rotated in said one direction C1 or rotated in the other direction C2.

In one embodiment of the present disclosure, as the plurality of blades 170 are disposed and spaced apart from each other, the water flow may be uniformly formed by the pillar. When the rotator 100 is rotated by the inclined extension form of the blade 170, not a simple rotational water flow, but the ascending water flow in which water at a lower portion of the drum 30 flows upward or the descending water flow in which water at an upper portion of the drum 30 flows downward may occur.

One embodiment of the present disclosure may form a three-dimensional water flow through the rotator 100, and thus greatly improve a washing efficiency for the laundry in the washing process. In addition, various washing schemes may be implemented by appropriately utilizing the ascending water flow and the descending water flow.

The blade 170 according to an embodiment of the present disclosure may have a screw shape. That is, the plurality of blades 170 may be disposed and be spaced apart from each other along the circumferential direction C of the pillar 150, and may extend in the form of the screw from one end 171 facing the bottom portion 110 to the other end 173 facing the open surface 31.

In other words, in one embodiment of the present disclosure, the plurality of blades 170 may extend while being wound on the outer circumferential surface 162 from said one end 152 facing the bottom portion 110 to the other end 154 facing the open surface 31.

In one example, when referring to FIG. 3, in one embodiment of the present disclosure, the blade 170 may be inclined in said one direction C1 among the circumferential directions C of the pillar 150 with respect to the longitudinal direction L of the pillar 150, and may extend from said one end 171 to the other end 173.

That is, the blade 170 may be constructed to be inclined in only said one direction C1 and not to be inclined in the other direction C2. When the inclination direction of the blade 170 is changed to the other direction C2 during the extension, during the rotation of the rotator 100, a portion of the blade 170 may generate the ascending water flow and the remaining portion may generate the descending water flow.

In this case, the ascending water flow and the descending water flow may occur simultaneously in the rotation of the rotator 100 in said one direction C1, so that it may be difficult to maximize the effect of either ascending or descending of the water.

Accordingly, in one embodiment of the present disclosure, the blade 170 extends obliquely with respect to the longitudinal direction L of the pillar 150, and extends obliquely to said one direction C1 among the circumferential directions C of the pillar 150, so that water flow characteristics for the rotation of the rotator 100 in said one direction C1 and the other direction C2 may be maximized. Said one direction C1 may be one of a clockwise direction and a counterclockwise direction, and the other direction C2 may be the other one.

In one example, in one embodiment of the present disclosure as shown in FIG. 3, the blade 170 may continuously extend from said one end 171 to the other end 173. That is, the blade 170 may be continuously extended without being cut between said one end 171 and the other end 173.

In addition, the blade 170 may extend from said one end 171 to the other end 173 to be continuously inclined with respect to the longitudinal direction L of the pillar 150. That is, the blade 170 may be formed in an inclined shape as a whole without a portion parallel to the longitudinal direction L of the pillar 150.

When at least a portion of the blade 170 is parallel to the longitudinal direction L or the circumferential direction C of the pillar 150, it may be disadvantageous to forming the ascending water flow or the descending water flow resulted from the rotation of the pillar 150. Accordingly, in one embodiment of the present disclosure, the blade 170 may be inclined with respect to the longitudinal direction L of the pillar 150 over an entire length L2.

Figure 4:
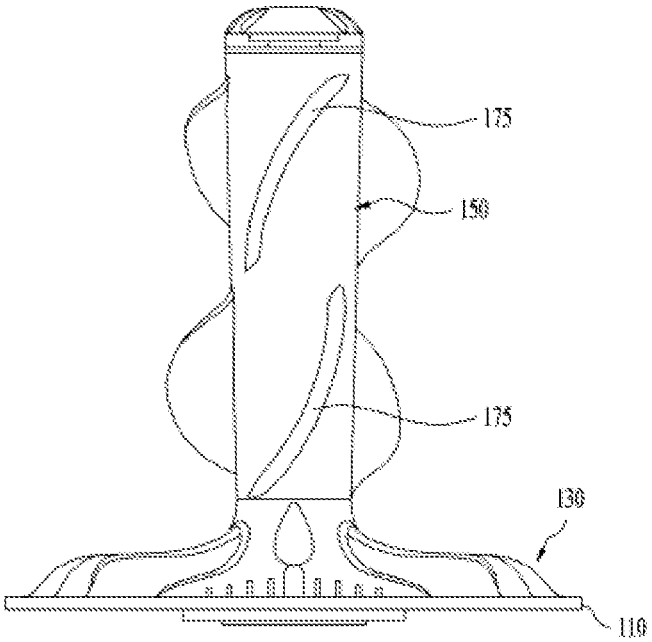
FIG. 4 is a view showing a blade composed of a plurality of divided bodies in a laundry treating apparatus according to another embodiment of the present disclosure.

In one example, another embodiment of the present disclosure is shown in FIG. 4. Referring to FIG. 4, in another embodiment of the present disclosure, the blade 170 may be composed of a plurality of divided bodies 175 separated from each other between said one end 171 and the other end 173.

In another embodiment of the present disclosure, a resistance of water acting on the blade 170 during the rotation of the rotator 100 may be reduced. Accordingly, a load of the driver 50 with respect to the rotation of the rotator 100 may be reduced.

FIG. 4 shows a state in which one blade 170 is composed of two divided bodies 175 according to another embodiment of the present disclosure. However, in FIG. 4, the two divided bodies 175 positioned in a line in a vertical direction do not constitute one blade 170 together. In FIG. 4, a divided body 175 located above corresponds to an upper portion of one blade 170, and a divided body 175 located below corresponds to a lower portion of a blade 170 adjacent to said one blade 170.

In the present disclosure, the blade 170 may be integrally formed or composed of the plurality of divided bodies 175 in consideration of a load of the driver 50, a washing efficiency, and the like that are typically expected in the laundry treating apparatus 1.

Figure 5:
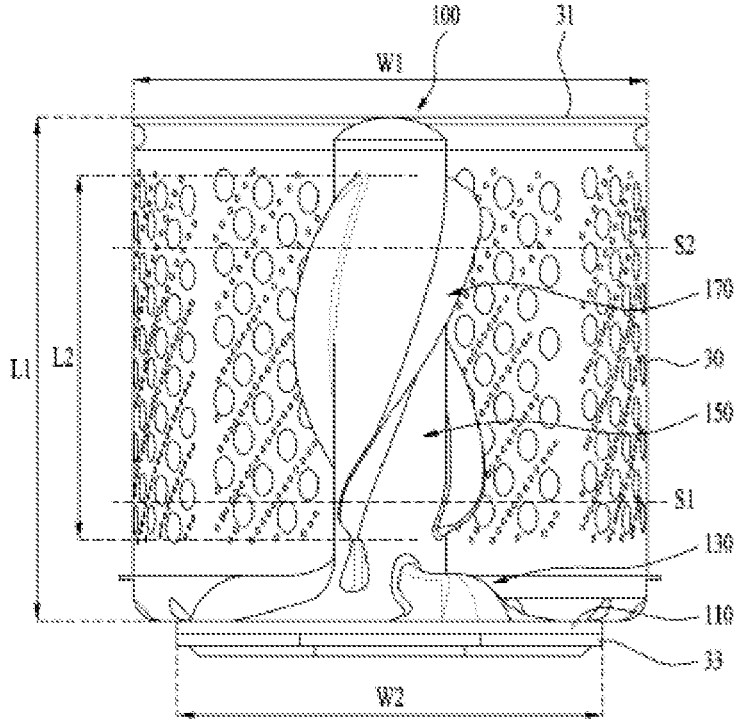
FIG. 5 is a view showing a drum and a rotator in a laundry treating apparatus according to an embodiment of the present disclosure.
Figure 6:
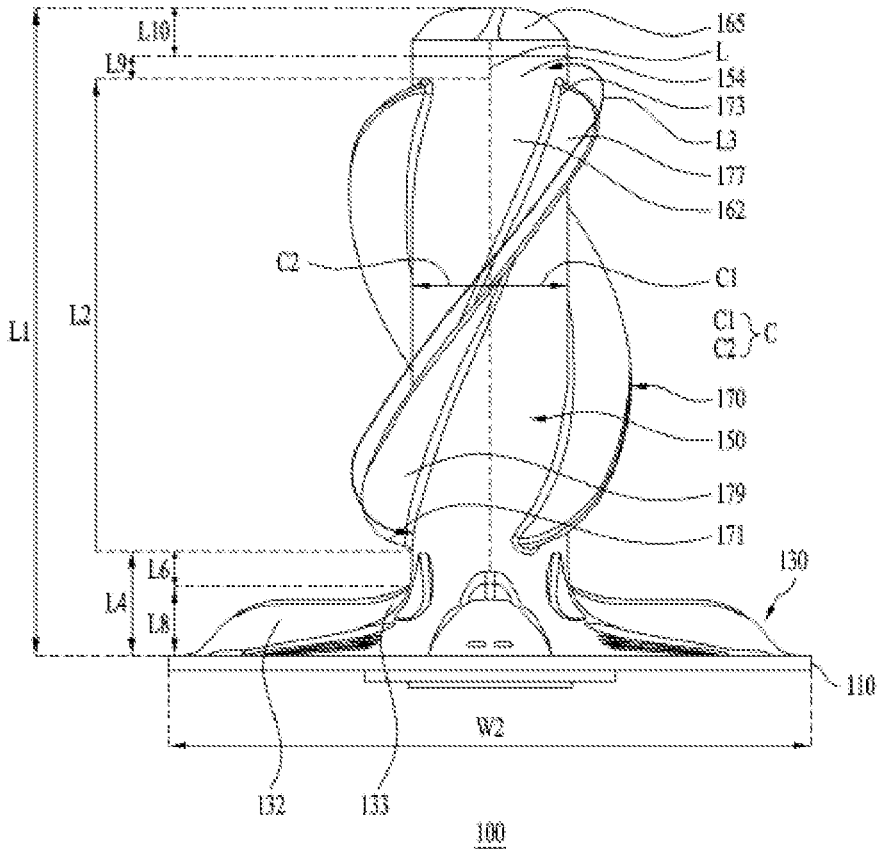
FIG. 6 is a side view of a rotator in a laundry treating apparatus according to an embodiment of the present disclosure.

In one example, FIG. 5 shows the rotator 100 disposed inside the drum 30 according to an embodiment of the present disclosure. FIG. 6 shows a side view of the rotator 100 according to an embodiment of the present disclosure.

Referring to FIGS. 5 and 6, in one embodiment of the present disclosure, the length L1 of the pillar 150 may be equal to or greater than 0.8 times and equal to or less than 1.2 times of the diameter W2 of the bottom portion 110.

Figure 21:
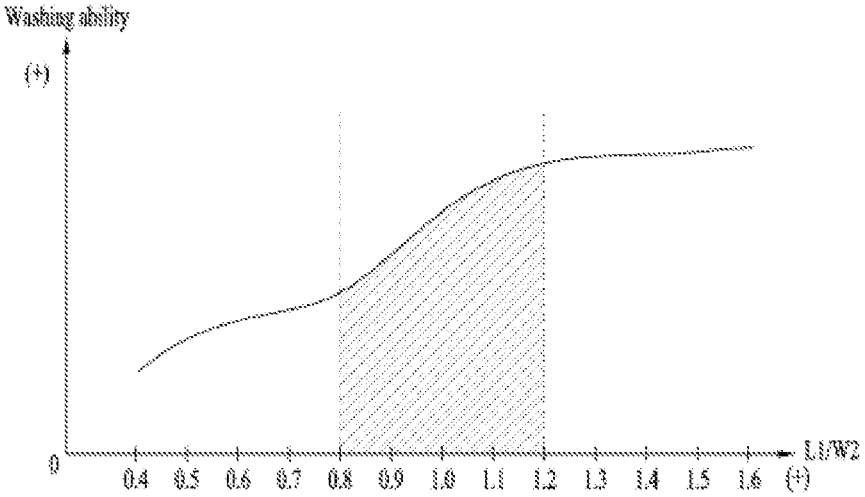
FIG. 21 is a graph showing a washing ability of a rotator based on a change in a length of a pillar with respect to a bottom portion in an embodiment of the present disclosure.

For example, the length L1 of the pillar 150 may be 0.8 times, 0.9 times, 1.0 times, 1, 1 times, or 1.2 times the diameter W2 of the bottom portion 110. However, the ratio of the length L1 of the pillar 150 to the diameter W2 of the bottom portion 110 is not necessarily limited thereto. In FIG. 5, the length L1 of the pillar 150 means a length from the top surface of the bottom portion 110 to the upper end of the pillar 150. FIG. 21 is a graph showing a washing ability of the rotator 100 based on the length L1 of the pillar 150 with respect to the diameter W2 of the bottom portion 110 in one embodiment of the present disclosure. In the graph of FIG. 21, a horizontal axis corresponds to the ratio of the length L1 of the pillar 150 to the diameter W2 of the bottom portion 110, and a vertical axis corresponds to the washing ability of the rotator 100.

The washing ability of the rotator 100 may be identified by a removal rate of an input. Specifically, a washing process of the laundry may be performed by adding a predetermined amount of input to the laundry put into the drum 30, and the washing ability may be identified by measuring an amount of the input separated and discharged in the washing process.

However, the washing ability of the rotator 100 is not limited to the above scheme, and it is also possible to derive the washing ability by analyzing an amount of water flow formed by observing a suspended matter put into the drum 30.

When the length L1 of the pillar 150 with respect to the diameter W2 of the bottom portion 110 is increased, the length of the blade 170 may also be increased, so that the washing ability may be increased. FIG. 21 is a result of maintaining the length of the blade 170 with respect to the length L1 of the pillar 150 at a predetermined ratio.

As shown in FIG. 21, in a region where the ratio of the length L1 of the pillar 150 to the diameter W2 of the bottom portion 110 is low, even when the length L1 of the pillar 150 is increased, the length of the blade 170 is equal to or less than a certain value, so that an increase in the washing ability may be relatively small.

In addition, because the length of the blade 170 is equal to or greater than a predetermined length in a region where the ratio of the length L1 of the pillar 150 with respect to the diameter W2 of the bottom portion 110 is high, the amount of water flow formed based on the increase in the length of the blade 170 may not be increased proportionally.

When the length L1 of the pillar 150 is too large, in the washing process, because a surplus length of the pillar 150 that is a length of a portion does not come into contact with the laundry and the water becomes excessive, it may lead to material loss, which may be disadvantageous.

Furthermore, the increase in the ratio of the length L1 of the pillar 150 may result in an increase in the load of the driver 50, and thus may be disadvantageous in overall washing efficiency. Therefore, as the length L1 of the pillar 150 increases, the washing ability may be effectively increased, and it is advantageous to identify an optimal range for minimizing an unnecessary increase in the load on the driver 50.

Further, in one embodiment of the present disclosure, the diameter W2 of the bottom portion 110 located on the bottom surface of the drum 30 may be a standard for reflecting the size of the drum 30 or an average water supply amount. Thus, one embodiment of the present disclosure is to identify the optimal range of the ratio of the length L1 of the pillar 150 with respect to the diameter W2 of the bottom portion 110, and provide the rotator 100 accordingly.

Referring to FIG. 21, it is shown that the washing ability is greatly increased starting from a ratio of 0.8 of the length L1 of the pillar 150 with respect to the diameter W2 of the bottom portion 110, and the increase rate of the washing ability is decreased starting from a length ratio of 1.2.

In consideration of the above results, in one embodiment of the present disclosure, the ratio of the length L1 of the pillar 150 with respect to the diameter W2 of the bottom portion 110 may be equal to or higher than 0.8 and equal to or lower than 1.2.

The diameter W2 of the bottom portion 110 may be determined variously in consideration of the diameter of the pillar 150, the sizes of the tub 20 and the drum 30 of the laundry treating apparatus 1, a capacity of the laundry allowed in the laundry treating apparatus 1, the amount of water supply resulted therefrom, and the like.

For example, the diameter W2 of the bottom portion 110 may be equal to or greater than 300 mm and equal to or smaller than 600 mm. The diameter W2 of the bottom portion 110 may be equal to or greater than 350 mm and equal to or smaller than 550 mm. The diameter W2 of the bottom portion 110 may be equal to or greater than 400 mm and equal to or smaller than 500 mm.

For example, the diameter W2 of the bottom portion 110 may be equal to or greater than 440 mm and equal to or smaller than 460 mm, and the diameter W2 of the bottom portion 110 may be 456 mm. The diameter W2 of the bottom portion 110, which corresponds to an example for helping the description and understanding of the present disclosure, is not intended to limit the present disclosure, and is able to allow for normal errors that may occur during manufacturing.

The length L1 of the pillar 150 may be variously determined in consideration of a diameter W1 of the drum 30 as well as a height of the drum 30, a diameter of the pillar 150, an inclination angle A of the blade 170, and the like.

For example, the length L1 of the pillar 150 may be equal to or greater than 300 mm and equal to or smaller than 600 mm. The length L1 of the pillar 150 may be equal to or greater than 350 mm and equal to or smaller than 550 mm. The length L1 of the pillar 150 may be equal to or greater than 400 mm and equal to or smaller than 500 mm.

For example, the length L1 of the pillar 150 may be equal to or greater than 440 mm and equal to or smaller than 460 mm. The length L1 of the pillar 150 may be 458 mm. The length L1 of the pillar 150 corresponds to an example for helping the description and understanding of the present disclosure, and does not limit the present disclosure, and may allow for normal errors that may occur during manufacturing. One embodiment of the present disclosure determines an allowable ratio between the length L1 of the pillar 150 and the diameter W2 of the bottom portion 110. Accordingly, the rotator 100 in which the load of the driver 50 is within an allowable range while the formation of the water flow by the pillar 150 is effectively achieved may be implemented.

In one example, in one embodiment of the present disclosure, the diameter W2 of the bottom portion 110 may be equal to or greater than 0.7 times and equal to less than 0.9 times the diameter W1 of the drum 30. However, the present disclosure is not necessarily limited thereto.

Because the bottom portion 110 is positioned on the bottom surface 33 of the drum 30 and rotated, the diameter W2 of the bottom portion 110 with respect to the diameter W1 of the drum 30 needs to be considered. When the diameter W2 of the bottom portion 110 is too small, the effect of the water flow by the rotation of the bottom portion 110 may be too small. When the diameter W2 of the bottom portion 110 is too large, it is easy to cause jamming of the laundry and is disadvantageous in the rotation by the load of the driver 50 and the like.

In addition, the increase in the diameter W2 of the bottom portion 110 including the protrusion 130 for the water flow formation may eventually be advantageous for improving the washing ability. However, because the increase in the diameter W2 of the bottom portion 110 and the washing ability increase rate are not necessarily proportional, it may be advantageous to determine the optimal range in consideration of the increase in the load of the driver 50 resulted from the increase in the diameter W2 of the bottom portion 110.

Figure 22:
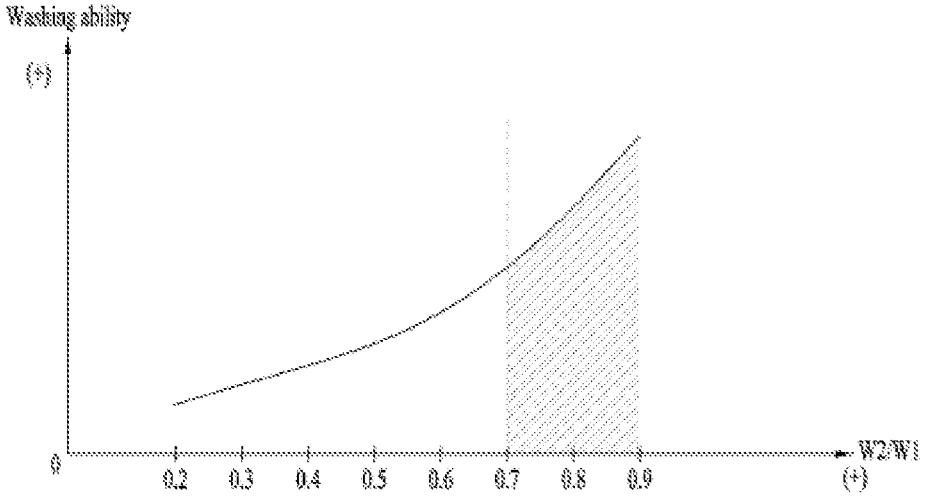
FIG. 22 is a graph showing a washing ability of a rotator based on a change in a diameter of a bottom portion with respect to a drum in an embodiment of the present disclosure.

FIG. 22 shows a graph showing a washing ability of the rotator 100 based on a ratio of the diameter W2 of the bottom portion 110 to the diameter W1 of the drum 30. A horizontal axis in FIG. 22 represents the ratio of the diameter W2 of the bottom portion 110 to the diameter W1 of the drum 30, and a vertical axis represents the washing ability by the rotator 100.

The graph of FIG. 22 is a resulted measured by changing the diameter W2 of the bottom portion 110 while maintaining the diameter W1 of the drum 30 at a predetermined value.

Referring to FIG. 22, it is identified that the washing ability increases as the ratio of diameter W2 of the bottom portion 110 to the diameter W1 of the drum 30 increases, and that the increase rate of the washing ability is largely increased starting from a ratio of diameter W2 of the bottom portion 110 to the diameter W1 of the drum 30 of 0.7.

Therefore, in one embodiment of the present disclosure, the rotator 100 is constructed such that the ratios of the diameter W2 of the bottom portion 110 with respect to the diameter W1 of the drum 30 is equal to or greater than 0.7 times, so that it is possible to use the ratio of the diameter W2 of the bottom portion 110 at which the washing ability may be effectively improved in spite of the increase in the load of the driver 50.

In one example, in one embodiment of the present disclosure, the ratio of the diameter W2 of the bottom portion 110 to the diameter W1 of the drum 30 may be equal to or less than 0.9 such that jamming of the laundry between the drum 30 and the bottom portion 110 is effectively suppressed, which may be derived from repeated experimental results considering design factors.

In one example, the diameter W1 of the drum 30 may be variously determined in consideration of a relationship between the capacity of the laundry allowed in the laundry treating apparatus 1, the water supply amount, and the tub 20.

For example, the diameter W1 of the drum 20 may be equal to or greater than 400 mm and equal to or smaller than 800 mm. The diameter W1 of the drum 20 may be equal to or greater than 500 mm and equal to or smaller than 700 mm. The diameter W1 of the drum 20 may be equal to or greater than 550 mm and equal to or smaller than 650 mm.

For example, the diameter W1 of the drum 20 may be equal to or greater than 590 mm and equal to or smaller than 610 mm, and the diameter W1 of the drum 20 may be 594 mm. The diameter W1 of the drum 20, which corresponds to an example for helping the description and understanding of the present disclosure, is not intended to limit the present disclosure, and is able to allow for normal errors that may occur during manufacturing.

In one example, in one embodiment of the present disclosure, the blade 170 may have a height L2 from said one end 171 to the other end 173 in the longitudinal direction L of the pillar 150 equal to or greater than 0.5 times the total height L1 of the pillar 150.

A vertical level L4 of said one end 171 and a vertical level of the other end 173 of the blade 170 may be defined as vertical distances from a top surface of the bottom portion 110 as shown in FIGS. 5 and 6. The height L2 from said one end 171 to the other end 173 of the blade 170 may be defined as the height of the blade 170.

The height L2 of the blade 170 may be determined in consideration of a relationship between an ascending amount and a descending amount of the water flow by the blade 170 and the load of the driver 50.

For example, as the height L2 of the blade 170 becomes smaller, the area in which the blade 170 is formed may be reduced, and the ascending amount and the descending amount of the water flow may be reduced.

In addition, as the height L2 of the blade 170 becomes greater, a water flow forming force may become stronger, but the load of the driver 50 may be increased. In addition, the height L2 of the blade 170 may be related to the inclination angle A of the blade 170, the diameter of the pillar 150, and the like.

Furthermore, the increase in the height L2 of the blade 170 may increase the amount of water flow generated and improve the washing ability eventually. However, because the increase in the height L2 of the blade 170 and the increase in the washing ability may not be proportional to each other, an unconditional increase in the height L2 of the blade 170 may not be effective in improving the washing ability.

Figure 23:
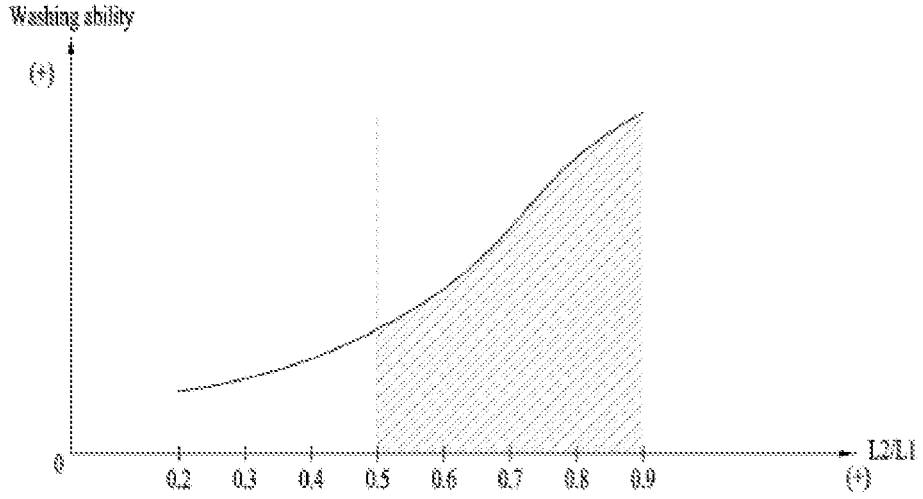
FIG. 23 is a graph showing a washing ability of a rotator based on a change in a height of a blade with respect to a height of a pillar in an embodiment of the present disclosure.

FIG. 23 shows a graph showing a washing ability of the rotator 100 based on a ratio of the height L2 of the blade 170 to the length L1 of the pillar 150, that is, the height L1 of the pillar 150. A horizontal axis of FIG. 23 represents the ratio of the height L2 of the blade 170 to the height L1 of the pillar 150, and the vertical axis represents the washing ability by the rotator 100.

The graph of FIG. 23 is a resulted measured by changing the height L2 of the blade 170 while maintaining the height L1 of the pillar 150 at a predetermined value.

Referring to FIG. 23, it is identified that the washing ability increases as the height L2 of the blade 170 increases, and that the increase rate of the washing ability is increased starting from a ratio of height L2 of the blade 170 to the height L1 of the pillar 150 of 0.5.

In consideration of the above results, in one embodiment of the present disclosure, the height L2 of the blade 170 may be equal to or greater than 0.5 times the length L1 of the pillar 150. Accordingly, in one embodiment of the present disclosure, the blade 170 may form an ascending water flow and a descending water flow effective inside the drum 30 effective when the pillar 150 rotates.

The height L2 of the blade 170 may be variously determined based on the size of the drum 30, the diameter W2 of the bottom portion 110, the height L1 of the pillar 150, the height of the protrusion 130, the position of the cap 165, and the like.

For example, the height L2 of the pillar 150 may be equal to or greater than 150 mm and equal to or smaller than 500 mm. The height L2 of the pillar 150 may be equal to or greater than 200 mm and equal to or smaller than 400 mm. The height L2 of the pillar 150 may be equal to or greater than 250 mm and equal to or smaller than 350 mm.

For example, the height L2 of the pillar 150 may be equal to or greater than 275 mm and equal to or smaller than 285 mm. The height L2 of the pillar 150 may be 279 mm. The height L2 of the pillar 150 corresponds to an example for helping the description and understanding of the present disclosure, and does not limit the present disclosure, and may allow for normal errors that may occur during manufacturing.

In one example, in one embodiment of the present disclosure, the blade 170 may have a length L3 extending from said one end 171 to the other end 173 along an extension direction equal to or greater than 1.4 times and equal to or less than 1.8 times the height L2 from said one end 171 to the other end 173 with respect to the longitudinal direction L of the pillar 150.

The length L3 extending from said one end 171 to the other end 173 along the extension direction of the blade 170 may be defined as an extension length of the blade 170, and the height L2 from said one end 171 to the other end 173 of the blade 170 may be defined as a height of the blade 170.

For example, when the number of turns that the blade 170 is wound on the pillar 150 at the same height L2 of the blade 170 is increased, the extension length L3 of the blade 170 is increased.

When the extension length L3 of the blade 170 with respect to the height L2 of the blade 170 becomes larger, a contact area between the blade 170 and the water may increase and the inclination angle A of the blade 170 may be increased.

Figure 9:
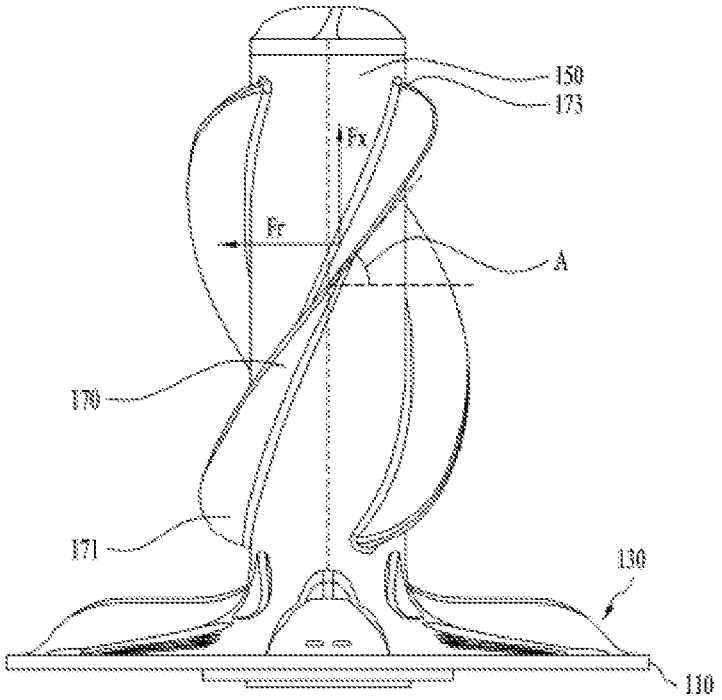
FIG. 9 is a view showing an inclination angle of a blade of a rotator in a laundry treating apparatus according to an embodiment of the present disclosure.

For reference, the inclination angle A of the blade 170 according to an embodiment of the present disclosure is shown in FIG. 9. Referring to FIG. 9, it may be understood that a case in which the height L2 of the blade 170 and the extended length L3 of the blade 170 are the same corresponds to a case in which the inclination angle A of the blade 170 corresponds to 90 degrees. In addition, it may be understood that as the extended length L3 of the blade 170 is gradually increased, the inclination angle A of the blade 170 is gradually lowered. A detailed description of the inclination angle A of the blade 170 shown in FIG. 9 will be described later.

As for the blade 170, as the inclination angle A of the blade 170 based on the circumferential direction C of the pillar 150 decreases, forming forces of the ascending water flow and the descending water flow generated when the rotator 100 rotates may be increased.

In FIG. 9, the inclination angle A of the blade 170 is defined with respect to the circumferential direction C of the pillar 150 and indicated. However, when considering the inclination angle A of the blade 170 based on the longitudinal direction L of the pillar 150, as the extended length L3 of the blade 170 increases, the inclination angle A of the blade 170 may increase as a result.

In one example, when the extended length L3 of the blade 170 is increased with respect to a predetermined height of the blade 170, the forming forces of the ascending water flow and the descending water flow by the blade 170 may be increased, but a forming force of a rotational water flow in the circumferential direction C of the pillar 150 may be reduced. When the forming force of the rotating water flow is reduced, the load acting on the driver 50 when the rotator 100 rotates may be reduced.

In one example, when the extended length L3 of the blade 170 is excessively reduced, the forming force of the rotational water flow may be increased. However, the load of the driver 50 may be increased, and the forming forces of the ascending water flow and the descending water flow of the water may be excessively reduced, which may be disadvantageous to the formation of the three-dimensional water flow and to the improvement of the washing efficiency.

Figure 24:
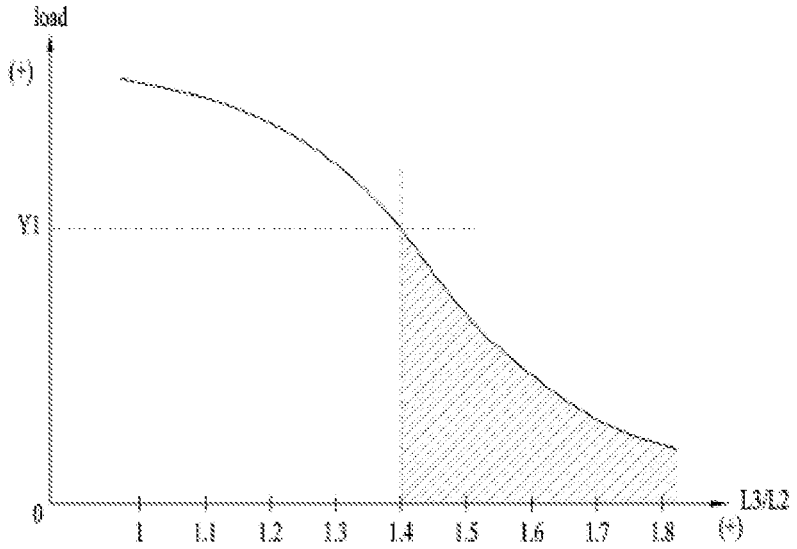
FIG. 24 is a graph showing a load of a driver based on a change in an extended length of a blade with respect to a height of the blade in an embodiment of the present disclosure.

FIG. 24 shows a graph showing a load of the driver 50 based on the extended length L3 of the blade 170 with respect to the height L2 of the blade 170 in one embodiment of the present disclosure. A horizontal axis of FIG. 23 represents the extended length L3 of the blade 170 with respect to the height L2 of the blade 170, and a vertical axis represents the load of the driver 50.

The load of the driver 50 may be identified by a difference between a target RPM input to the driver 50 by the controller 70 and an actual RPM that follows the target RPM. The load of the driver 50 may also be identified through a change in a current value supplied to the driver 50.

The graph of FIG. 24 is a result of measuring the load of the driver 50 by changing the extended length L3 of the blade 170 while fixing the height of the pillar and the height L2 of the blade 170 to predetermined heights.

Referring to FIG. 24, it is identified that the load of the driver 50 is reduced as the extended length L3 of the blade 170 is increased. This is understood as a result of the decrease in the inclination angle A of the blade 170 resulted from the increase in the extended length L3 of the blade 170, and the decrease in the resistance of water to the rotation of the rotator 100 resulted from the decrease in the inclination angle A of the blade 170.

However, it is identified that a reduction rate of the load of the driver 50 based on the increase in the extended length L3 of the blade 170 increases starting from a ratio of the extended length L3 of the blade 170 to the height L2 of the blade 170 of 1.4, which may be understood as a complex result reflecting fluidity of water.

In one example, an allowable load amount Y1 is indicated in FIG. 24. The load of the driver 50 is related to a resistance acting on the blade 170, and the allowable load amount Y1 means a load amount of the driver 50 that is identified through theoretical prediction and repeated experiments to cause damage to the blade 170. However, the allowable load amount Y1 may be variously determined in consideration of a mechanical limit or a control aspect of the driver 50 as well as the resistance of the blade 170.

As shown in FIG. 24, the load of the driver 50 is equal to or less than the allowable load amount Y1 at a ratio of the extended length L3 of the blade 170 equal to or higher than 1.4. Therefore, the rotator 100 with the ratio of the extended length L3 of the blade 170 to the height L2 of the blade 170 equal to or higher than 1.4 is advantageous for the operation of the driver 50 while effectively suppressing the damage of the blade 170.

Therefore, in one embodiment of the present disclosure, the extended length L3 of the blade 170 is equal to or greater than 1.4 times the height L2 of the blade 170, so that the inclination angle A of the blade 170 that may effectively form the forming forces of the ascending water flow and the descending water flow may be secured, and unnecessary load increase of the driver 50 may be prevented.

In addition, in one embodiment of the present disclosure, the extended length L3 of the blade 170 is equal to or less than 1.8 times the height L2 of the blade 170, so that the forming force of the rotating water flow parallel to the circumferential direction C of the pillar 150 may be effectively secured in addition to the forming forces of the ascending water flow and the descending water flow.

Figure 25:
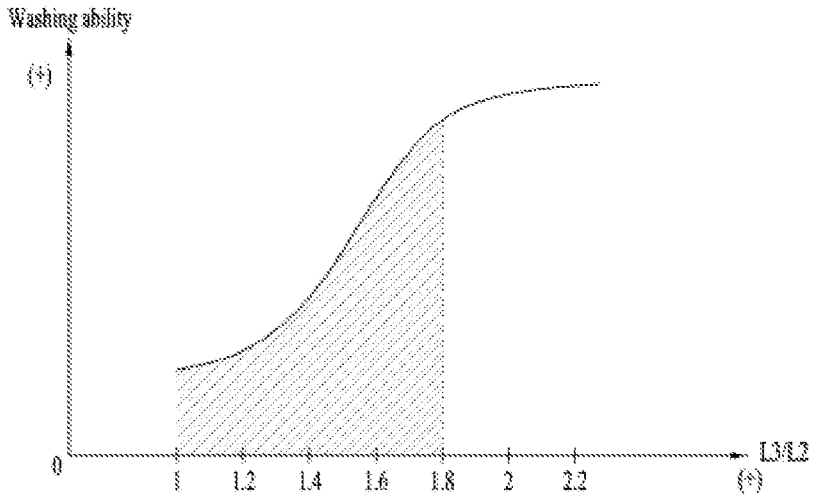
FIG. 25 is a graph showing a washing ability of a rotator based on a change in an extended length of a blade with respect to a height of the blade in an embodiment of the present disclosure.

FIG. 25 shows a graph showing a washing ability of the rotator 100 based on the extended length L3 of the blade 170 with respect to the height L2 of the blade 170 in one embodiment of the present disclosure. A horizontal axis of FIG. 25 represents the extended length L3 of the blade 170 with respect to the height L2 of the blade 170, and a vertical axis represents the washing ability of the rotator 100.

The graph of FIG. 25 is a result of measuring the washing ability of the rotator 100 by changing the extended length L3 of the blade 170 while fixing the height of the pillar 150 and the height of the blade 170 to the predetermined heights.

Referring to FIG. 25, it is identified that the washing ability increases relatively significantly as the extended length L3 of the blade 170 increases when the extended length L3 of the blade 170 is equal to or less than 1.8 times the height L2 of the blade 170, and the increase in the washing ability is reduced when the extended length L3 of the blade 170 is greater than 1.8 times the height L2 of the blade 170. This is to be understood as a result of decreasing a water flow forming ability while a contact area between water and the blade 170 increases when the extended length L3 of the blade 170 exceeds 1.8 times the height L2 of the blade 170.

Therefore, in one embodiment of the present disclosure, the extended length L3 of the blade 170 is equal to or less than 1.8 times the height L2 of the blade 170, thereby effectively improving the washing ability while minimizing the unnecessary increase in the load of the driver 50.

The extended length L3 of the blade 170 may be variously determined depending on the height L2 of the blade 170, the diameter of the pillar 150, the inclination angle A of the blade 170, the load amount of the driver 50, a water flow formation level, and the like.

For example, the extended length L3 of the blade 170 may be equal to or greater than 300 mm and equal to or smaller than 600 mm. The extended length L3 of the blade 170 may be equal to or greater than 350 mm and equal to or smaller than 550 mm. The extended length L3 of the blade 170 may be equal to or greater than 400 mm and equal to or smaller than 500 mm.

For example, the extended length L3 of the blade 170 may be equal to or greater than 460 mm and equal to or smaller than 480 mm. The extended length L3 of the blade 170 may be 468 mm. The extended length L3 of the blade 170 corresponds to an example for helping the description and understanding of the present disclosure, and does not limit the present disclosure, and may allow for normal errors that may occur during manufacturing.

In one example, one embodiment of the present disclosure may include the water supply 60 and the controller 70 as described above. The water supply 60 may be constructed to supply the water into the tub 20, and the controller 70 may control the water supply 60 in the washing process to adjust the amount of water supplied.

The controller 70 may control the water supply 60 such that the amount of water supplied preset based on an amount of laundry selected by the user through the manipulation unit in the washing process is supplied into the tub 20.

For example, when the user selects a minimum amount as the amount of laundry or when the amount of laundry is identified to be the minimum amount through a sensor or the like, a minimum amount of water supplied corresponding to the minimum amount of laundry may be preset in the controller 70, and the controller 70 may control the water supply 60 such that the minimum amount of water supplied is supplied into the tub 20.

In addition, when the amount of laundry is identified as a maximum amount by the user, the sensor, or the like, a maximum amount of water supplied corresponding to the maximum amount of laundry may be preset in the controller 70, and the controller 70 may control the water supply 60 such that the maximum amount of water supplied is supplied into the tub 20.

There may be various minimum criteria for the amount of laundry. For example, in a standard washing ability test in the United States, an amount of laundry of 3 kg or an amount of laundry of 8 lb is presented as a small amount criteria. In one embodiment of the present disclosure, the minimum amount of water supplied may be an amount of water supplied preset for the laundry amount corresponding to 8 lb. In addition, there may be various maximum criterion for the amount of laundry.

In one embodiment of the present disclosure, a water surface S1 corresponding to the minimum amount of water supplied and a water surface S2 corresponding to the maximum amount of water supplied are shown in FIG. 5. Referring to FIG. 5, in one embodiment of the present disclosure, the controller 70 may control the water supply 60 such that the amount of water supplied is equal to or greater than the preset minimum amount of water supplied in the washing process, and the blade 170 may be constructed such that the vertical level L4 of said one end 171 with respect to the bottom portion 110 is equal to or lower than a vertical level of the water surface S1 corresponding to the minimum amount of water supplied.

Figure 7:
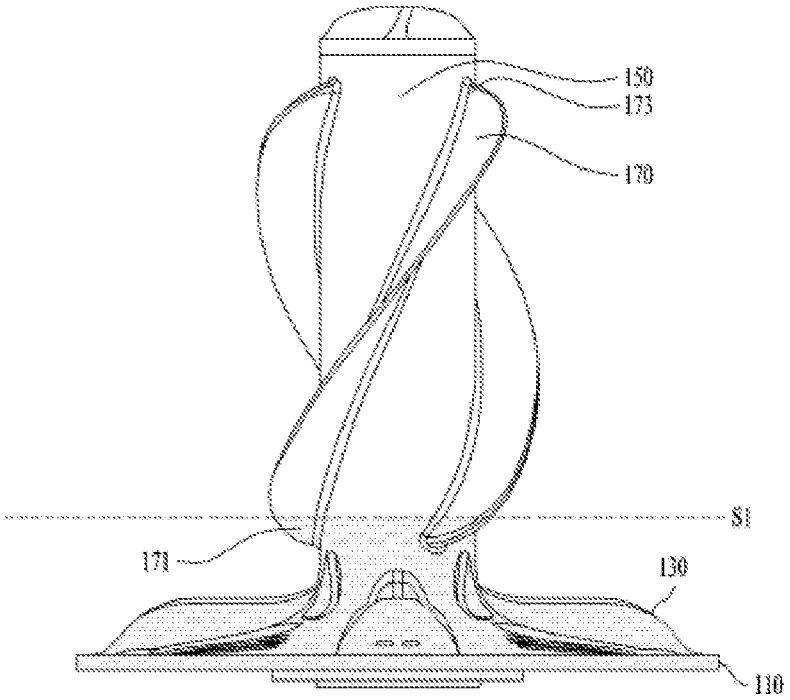
FIG. 7 is a view showing a contact area with water of a rotator in FIG. 6 for a minimum water supply amount.

FIG. 7 shows a contact area between water and the rotator 100 having said one end 171 of the blade 170 at a vertical level equal to or lower than a vertical level of the water surface S1 corresponding to the minimum water supply amount, according to one embodiment of the present disclosure.

When the blade 170 is not submerged in the water, even when the rotator 100 rotates, the ascending water flow and the descending water flow by the blade 170 are not formed, which is disadvantageous. Therefore, in one embodiment of the present disclosure, in the washing process, at least the minimum amount of water supplied may be supplied into the tub 20. In addition, as shown in FIG. 7, said one end 171 of the blade 170 may be positioned at a vertical level equal to or lower than the vertical level of the water surface S1 corresponding to the preset minimum amount of water supplied such that the blade 171 may be always positioned at a vertical level equal to or lower than a vertical level of a water surface and submerged in the water despite a change in the amount of water supplied.

The minimum amount of water supplied may be the amount of water supplied for the amount of laundry of 8 lb, which is a criteria of a small load test in the authorized laundry test in the United States, as described above.

In one example, in one embodiment of the present disclosure, the height L4 of the blade 170 may be equal to or less than 0.25 times the diameter W1 of the drum 30. This means an optimal design value and the present disclosure is not necessarily limited thereto.

One embodiment of the present disclosure allows said one end 171 of the blade 170 to be always submerged in the water in the washing process or the rinsing process, so that the water flow formation effect by the rotation of the rotator 100 may occur effectively. To this end, the height L4 of the blade 170 may be designed to be 0.25 times the diameter W1 of the drum 30.

As shown in FIGS. 5 and 6, when the pillar 150 protrudes upward from the bottom portion 110, the vertical level L4 of said one end 171 of the blade 170 may correspond to a vertical upward distance from the bottom portion 110.

The vertical level L4 of said one end 171 of the blade 170 may be specifically determined based on the minimum amount of water supplied and the diameter W1 of the drum 30. For example, the larger the minimum amount of water supplied, the higher the vertical level L4 of said one end 171 of the blade 170 may be determined. In addition, the larger the diameter W1 of the drum, the lower the vertical level L4 of said one end 171 of the blade 170.

In one embodiment of the present disclosure, the minimum amount of water supplied may be the amount of water supplied for the amount of laundry of 8 lb as described above. Considering the diameter W1 of the drum 30 that is usually determined therefor, the height L4 of the blade 170 may be equal to or less than 0.25 times the diameter W1 of the drum 30, and the vertical level L4 may be lower than the vertical level of the water surface S1.

Figure 26:
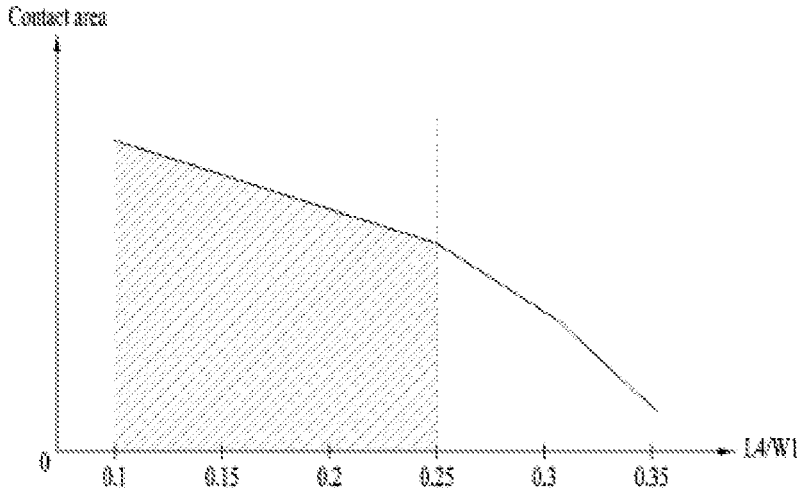
FIG. 26 is a graph showing a water contact area of a blade based on a change in a vertical level of one end of a blade with respect to a drum in an embodiment of the present disclosure.

FIG. 26 is a graph showing a water contact area of the blade 170 based on the height L4 of the blade 170 with respect to the diameter W1 of the drum 30 in one embodiment of the present disclosure. A horizontal axis of FIG. 26 represents the height L4 of the blade 170 with respect to the diameter W1 of the drum 30, and a vertical axis represents the water contact area of the blade 170.

The graph in FIG. 26 is a result of measuring the water contact area of the blade 170 by changing the height L4 of the blade 170 with respect to the bottom portion 110 while maintaining shape characteristics of the blade 170 constant.

The minimum water supply amount may be changed based on the size of the drum 30 and the like. Therefore, the minimum water supply amount may be reflected in the change in the diameter W1 of the drum 30. Thus, in the graph of FIG. 25, the height L4 of the blade 170 with respect to the diameter W1 of the drum 30 was used as the horizontal axis variable. The contact area between the blade 170 and water may be identified by diluting a colored dye with water and identifying the contact area marked on the blade 170.

Referring to FIG. 26, as the height L4 of the blade 170 decreases, the water contact area of the blade 170 decreases. However, it may be seen that a reduction rate of the water contact area is increased when the height L4 of the blade 170 exceeds 0.25 times the diameter W1 of the drum 30.

The change in the reduction rate of the water contact area as described above may be a result affected by the shape characteristics of said one end 171 of the blade 170. For example, the blade 170 may have a shape in which a surface area thereof is reduced toward said one end. Accordingly, a change may occur in the rate of change of the water contact area based on the change in the height L4 of the blade 170.

In one example, as will be described later, said one end 171 of the blade 170 is spaced apart from the bottom portion 110, the main protrusion 132, or the like to define a passage region of water, thereby reducing the load of the driver 50. That is, when the height L4 of the blade 170 is increased, it may be advantageous to reduce the load on the driver 50.

Therefore, in one embodiment of the present disclosure, the height L4 of the blade 170 is equal to or less than 0.25 times the diameter of the drum 30, so that the passage region of water may be defined and the load of the driver 50 may be reduced by spacing said one end 171 of the blade 170 apart from the bottom portion 110 and the like, and the washing efficiency may be effectively improved by minimizing the decrease in the water contact area based on the increase in the height L4 of the blade 170.

The height L4 of the blade 170 may be determined in consideration of various factors such as the length of the pillar 150, the height of the main protrusion 132 to be described later, setting of the passage region of water, and the like, in addition to the water contact area.

For example, the height L4 of the blade 170 may be equal to or greater than 50 mm and equal to or smaller than 150 mm. The height L4 of the blade 170 may be equal to or greater than 60 mm and equal to or smaller than 140 mm. The height L4 of the blade 170 may be equal to or greater than 70 mm and equal to or smaller than 130 mm.

For example, the height L4 of the blade 170 may be equal to or greater than 80 mm and equal to or smaller than 120 mm. The height L4 of the blade 170 may be 95 mm. The height L4 of the blade 170 corresponds to an example for helping the description and understanding of the present disclosure, and does not limit the present disclosure, and may allow for normal errors that may occur during manufacturing.

In one example, in an embodiment of the present disclosure, as for the blade 170, said one end 171 may be located below a water surface of the water stored in the tub 20 and the other end 173 may be located above the water surface in the washing process.

Figure 8:
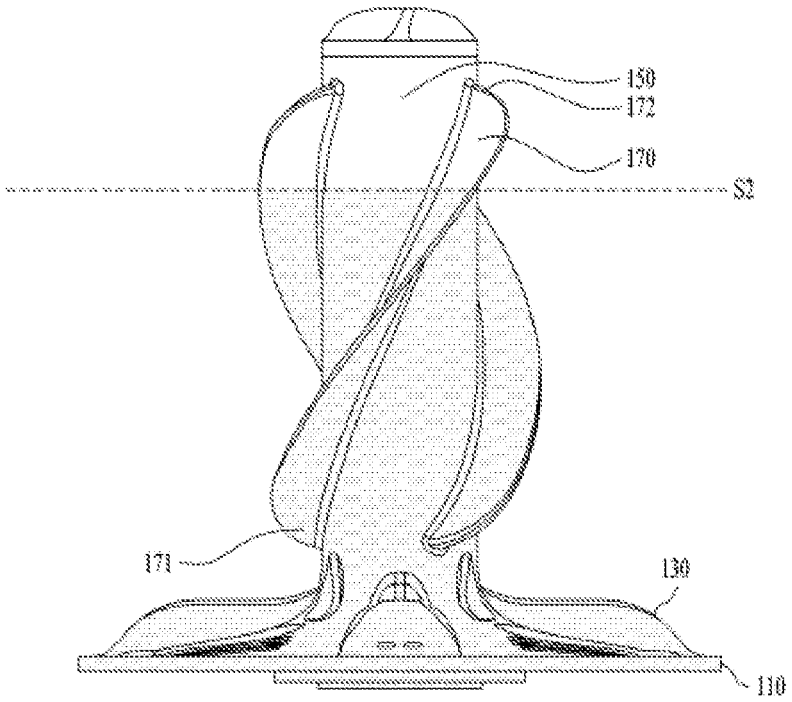
FIG. 8 is a view showing a contact area with water of a rotator in FIG. 6 for a maximum water supply amount.

In FIG. 5, the vertical level of the water surface S1 at the minimum amount of water supplied and the vertical level of the water surface S2 at the maximum amount of water supplied, according to an embodiment of the present disclosure are indicated. FIG. 8 shows a contact area between the rotator 100 and water with the maximum water supply amount according to an embodiment of the present disclosure.

As shown in FIGS. 5 and 8, it is shown that said one end 171 of the blade 170 is located at a vertical level closer to the bottom portion 110 than the vertical level of the water surface S1 based on the minimum amount of water supplied, and the other end 173 of the blade 170 is located at a vertical level further from the bottom portion 110 than the vertical level of the water surface S2 based on the maximum amount of water supplied.

In one embodiment of the present disclosure, the other end 173 of the blade 170 is disposed to be spaced apart from the water surface of the water stored in the tub 20 toward the open surface 31 at all times, so that the water flow by the blade 170 may always be formed up to an upper portion of the water even when the amount of water stored in the tub 20 is changed in the washing process.

The position of the other end 173 of the blade 170 may be determined in consideration of various factors such as the diameter W1 of the drum 30, the maximum amount of water supplied, the length L1 of the pillar 150, and the like.

In one example, in the laundry treating apparatus 1 according to one embodiment of the present disclosure, the controller 70 may control the water supply 60 such that the amount of water supplied is equal to or less than the preset maximum amount of water supplied in the washing process. In addition, the blade 170 may be constructed such that the vertical level of the other end 173 with respect to the bottom portion 110 may be equal to or higher than the vertical level of the water surface S2 corresponding to the maximum amount of water supplied.

The amount of water supplied to the tub 20 may vary based on the amount of laundry or the result of manipulation of the manipulation unit by the user. One embodiment of the present disclosure allows the other end 173 of the blade 170 to be located at the vertical level equal to or higher than the vertical level of the water surface S2 even for the maximum amount of water supplied that may be provided to the tub 20 in the washing process, so that the water flow by the blade 170 may be formed up to the upper portion of the water stored in the tub 20 even when the amount of water supplied is changed.

In one example, FIG. 9 shows the inclination angle A of the blade 170 extending obliquely with respect to the circumferential direction C of the pillar 150 according to an embodiment of the present disclosure. Referring to FIG. 9, in one embodiment of the present disclosure, the blade 170 may extend such that the inclination angle A with respect to the circumferential direction C of the pillar 150 is uniform. FIG. 9 shows the circumferential direction C of the pillar 150 and the inclination angle A with respect thereto.

The blade 170 may be disposed on the outer circumferential surface 162 of the pillar 150, extend from said one end 171 facing toward the bottom portion 110 to the other end 173 facing toward the open surface 31, extend in a form inclined with respect to the longitudinal direction L or the circumferential direction C of the pillar 150, and extend such that the inclination angle A with respect to the circumferential direction C of the pillar 150 is uniform.

When the inclination angle A of the blade 170 changes, the inclination angle A of the blade 170 is changed over the height of the pillar 150, so that formation levels of the ascending water flow and the descending water flow may be different. In addition, in the process of forming the blade 170 on the outer circumferential surface 162 of the pillar 150, the change of the inclination angle A of the blade 170 may be disadvantageous in manufacturing and may limit a manufacturing scheme.

For example, when the inclination angle A of the blade 170 is uniform, uniform formation of the ascending water flow and the descending water flow may be expected throughout the length L1 of the pillar 150, and a mold may be simply rotated and separated in the process of integrally molding the pillar 150 and the blade 170, which may be advantageous in manufacturing.

In one example, in one embodiment of the present disclosure, the inclination angle A of the blade 170 may be variously determined in relation to the length L1 of the pillar 150, the diameter of the pillar 150, the number of turns of the blade 170, and the like.

When the inclination angle A of the blade 170 with respect to the circumferential direction C of the pillar 150 is too small, For a certain number of turns of the blade 170, the height L2 of the blade 170 in the pillar 150 is too small to reduce the water flow formation effect.

In addition, when the inclination angle A of the blade 170 is too large, mechanical loads acting on the blade 170 and the pillar 150 may be increased when the rotator 100 rotates, the load of the driver 50 may also be increased, and the effect of ascending and descending of water for the same number of rotations of the rotator 100 may be reduced, which may be disadvantageous.

In one example, FIG. 9 shows a horizontal force Fr and a vertical force Fz acting by the blade 170. The horizontal force Fr and the vertical force Fz mean forces acting on the water by the rotation of the blade 170, the horizontal force Fr means a force acting in the circumferential direction C of the pillar 150, and the vertical force Fz means a force acting in the longitudinal direction L of the pillar 150.

The horizontal force Fr and the vertical force Fz of the blade 170 affect the water flow formation. For example, the horizontal force Fr of the blade 170 may contribute to forming the rotational water flow, and the vertical force Fz of the blade 170 may contribute to forming the ascending water flow or the descending water flow. The horizontal force Fr of the blade 170 may correspond to the load of the driver 50.

The horizontal force Fr and the vertical force Fz of the blade 170 may be adjusted by the inclination angle A of the blade 170. Referring to FIG. 9, as the inclination angle A of the blade 170 increases, the horizontal force Fr may become stronger and the vertical force Fz may become weaker, and as the inclination angle A of the blade 170 decreases, the horizontal force Fr may become weaker and the vertical force Fz may become stronger.

In one embodiment of the present disclosure, as the ascending water flow or the descending water flow is formed together in addition to the rotating water flow through the rotation of the rotator 100 including the blade 170 extending obliquely, the washing efficiency may be improved through the three-dimensional water flow.

In improving the washing efficiency by forming the rotating water flow together with the ascending water flow or the descending water flow as above, as a deviation between the horizontal force Fr and the vertical force Fz by the blade 170 is large, only one water flow is strongly formed, which may be disadvantageous in improving the washing efficiency.

Therefore, one embodiment of the present disclosure may set an optimal range for the inclination angle A of the blade 170, and thus, make the deviation between the horizontal force Fr and the vertical force Fz of the blade 170 to be equal to or less than an allowable deviation amount Y2, thereby effectively improving the washing ability resulted from the rotation of the rotator 100.

Figure 27:
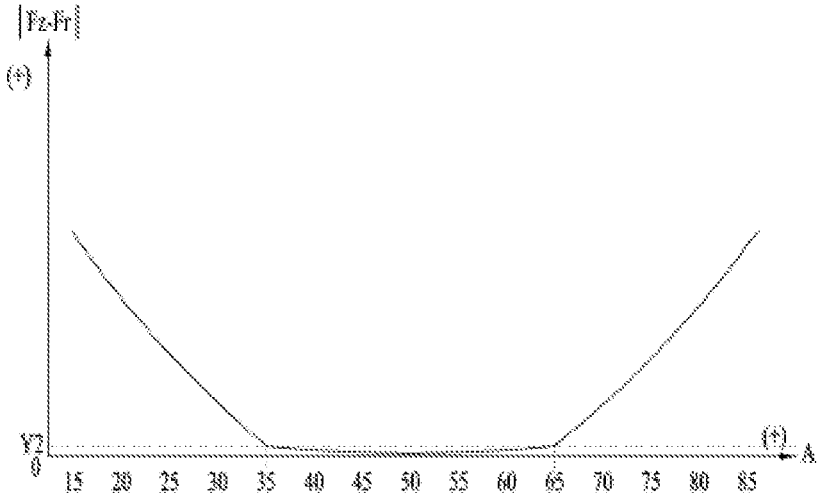
FIG. 27 is a graph showing a deviation between a horizontal force and a vertical force of a blade based on an inclination angle of the blade in an embodiment of the present disclosure.

FIG. 27 is a graph showing the amount of deviation between the horizontal force Fr and the vertical force Fz of the blade 170 based on the inclination angle A of the blade 170 in one embodiment of the present disclosure. A horizontal axis of FIG. 27 represents the inclination angle A of the blade 170, and a vertical axis represents the amount of deviation between the horizontal force Fr and the vertical force Fz.

In the graph of FIG. 27, the amount of deviation between the horizontal force Fr and the vertical force Fz corresponds to an absolute value. That is, the deviation amount represents a numerical difference between the horizontal force Fr and the vertical force Fz and does not have a negative value.

Referring to FIG. 27, it may be seen that the amount of deviation between the horizontal force Fr and the vertical force Fz of the blade 170 is equal to or less than the allowable deviation amount Y2 when the inclination angle A of the blade 170 is equal to or larger than 35 degrees and equal to or smaller than 65 degrees.

The allowable deviation amount Y2 may be determined through repeated experiments of the actual washing process with reference to a theoretical calculation result. The allowable deviation amount Y2 may be set to various values as needed.

When considering the graph of FIG. 27, in one embodiment of the present disclosure, the blade 170 may have the inclination angle A equal to or larger than 35 degrees and equal to or smaller than 65 degrees. Therefore, the amount of deviation between the vertical force Fz and the horizontal force Fr becomes equal to or less than the allowable deviation amount Y2, so that, in addition to the rotating water flow, the ascending water flow or the descending water flow is effectively formed, thereby improving the washing efficiency through the three-dimensional water flow.

The inclination angle A of the blade 170 may be strategically determined in consideration of the amount of deviation between the horizontal force Fr and the vertical force Fz as well as the length L1 of the pillar 150 and the water flow formation level. The numerical value for the inclination angle A of the blade 170 may allow a normal error range that may occur during manufacturing.

Figure 10:
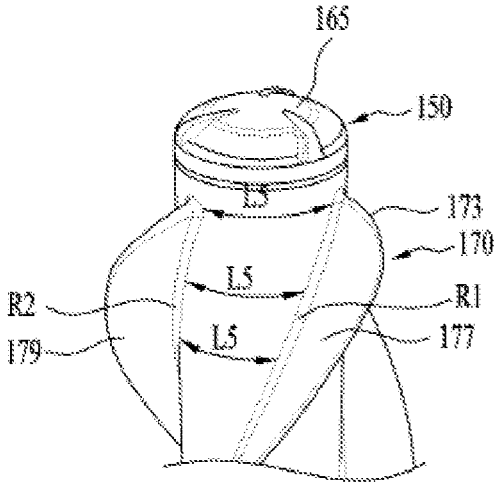
FIG. 10 is a view showing a state in which blades spaced apart from each other are formed on a rotator of a laundry treating apparatus according to an embodiment of the present disclosure.

In one example, FIG. 10 shows a plurality of blades 170 spaced apart from each other along the circumferential direction C of the pillar 150. Referring to FIG. 10, the blade 170 may extend from said one end 171 to the other end 173 while maintaining a spaced distance L5 between the plurality of blades 170 in the circumferential direction C of the pillar 150 constant.

In one embodiment of the present disclosure, the inclination angle A of the blade 170 may be constant over the extended length thereof, and the spaced distance L5 between the blades 170 in the circumferential direction C of the pillar 150 may be maintained constant over the height of the pillar 150.

FIG. 10 shows a state in which the spaced distance L5 between the blades 170 is always maintained uniform at positions at which a vertical level of the pillar 150 is gradually increased according to one embodiment of the present disclosure.

Figure 11:
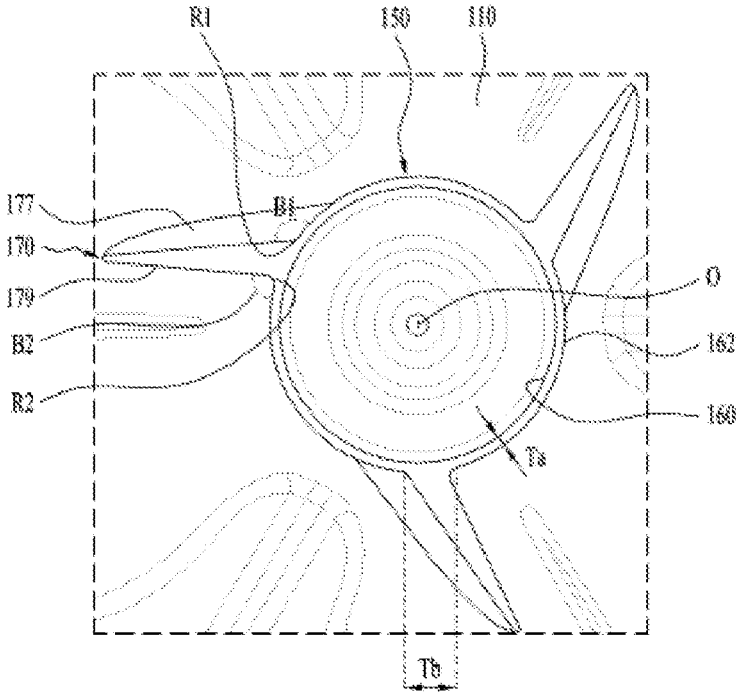
FIG. 11 is a view showing a cross-section of a pillar in a laundry treating apparatus according to an embodiment of the present disclosure.

In one example, FIG. 11 is a cross-sectional view of the pillar 150 according to an embodiment of the present disclosure viewed from the open surface 31.

In one embodiment of the present disclosure, the blade 170 may have at least one surface 177 facing toward the open surface 31, and the other surface 179 located on the opposite side of the one surface 177 and at least partially facing toward the bottom portion 110.

In one embodiment of the present disclosure, when viewed from the open surface 31, said one surface 177 may be connected to form an obtuse angle with respect to the outer circumferential surface 162 of the pillar 150 and the other surface 179 may be connected to form an acute angle.

Specifically, the blade 170 may protrude from the outer circumferential surface 162 of the pillar 150 outwardly of the pillar 150, and may have said one surface 177 and the other surface 179. In one embodiment of the present disclosure, said one surface 177 of the blade 170 may be understood as a surface at least a portion of which faces toward the open surface 31, and the other surface 179 of the blade 170 may be understood as a surface at least a portion of which faces toward the bottom portion 110.

That is, as shown in FIG. 6, when the blade 170 extends obliquely in said one direction C1 among the circumferential directions C of the pillar 150, said one surface 177 of the blade 170 may correspond to a surface directed in the other direction C2 among the circumferential directions C of the pillar 150, and the other surface 179 of the blade 170 may correspond to a surface directed in said one direction C1 among the circumferential directions C of the pillar 150.

Said one surface 177 of the blade 170 may correspond to a surface that ascends water upward when the pillar 150 rotates in the other direction C2, and the other surface 179 of the blade 170 may correspond to a surface that descends water to downward when the pillar 150 rotates in said one direction C1.

In addition, referring to FIG. 11, when viewed from the open surface 31 or when viewed from above when the pillar 150 extends in the vertical direction, said one surface 177 of the blade 170 may be connected such that an angle B1 thereof with respect to the outer circumferential surface 162 of the pillar 150 forms an obtuse angle.

Accordingly, when the pillar 150 is rotated, said one surface 177 of the blade 170 may move such that the resistance by water may be effectively reduced, and the water and the laundry may spread outward in a radial direction of the bottom portion 110, thereby preventing tangling of the laundry.

For example, when said one surface 177 of the blade 170 forms an acute angle with respect to the outer circumferential surface 162 of the pillar 150, the laundry may show a tendency to gather to the center O of the pillar 150 when the rotator 100 is rotated to form the ascending water flow. When the pillar 150 is extended in the vertical direction, it may be difficult for the laundry, which gathers to the center O of the pillar 150, to spread to the inner circumferential surface of the drum 30 again by the self load of the laundry.

Therefore, in one embodiment of the present disclosure, when the pillar 150 rotates in the other direction C2, said one surface 177 of the blade 170 that forms the ascending water flow forms an obtuse angle with respect to the outer circumferential surface 162 of the pillar 150, so that, together with the formation of the ascending water flow, the laundry may be moved to be away from the pillar 150, thereby suppressing the tangling of the laundry.

In addition, when the rotator 100 rotates to form the ascending water flow, self loads of the water and the laundry may act on the blade 170. When said one surface 177 that contributes to forming the ascending water flow in the blade 170 forms the acute angle, it may be disadvantageous because the load acting on the blade 170 increases excessively.

Therefore, one embodiment of the present disclosure makes said one surface 177 of the blade 170 that forms the ascending water flow form the obtuse angle with respect to the outer circumferential surface 162 of the pillar 150, thereby effectively reducing the load acting on the blade 170.

In one example, when viewed from the open surface 31, the other surface 179 of the blade 170 may be connected while an angle B2 thereof with respect to the outer circumferential surface 162 of the pillar 150 forms an acute angle. The other surface 179 of the blade 170 may be constructed to form the acute angle with respect to the outer circumferential surface 162 of the pillar 150 in a geometric relationship with said one surface 177 of the blade 170 that forms the obtuse angle with respect to the outer circumferential surface 162 of the pillar 150.

In addition, in one embodiment of the present disclosure, as the other surface 179 of the blade 170 forms the acute angle, when the rotator 100 is rotated in said one direction C1 to form the descending water flow by the other surface 179 of the blade 170, a water flow in which the laundry gathers toward the pillar 150 is formed, so that a motion in which laundry existing at a lower portion of the drum 30 is pushed by laundry at an upper portion to be away from the pillar 150 may be induced.

Such movement tendency of the laundry in the descending water flow may be related to the self load of the laundry. That is, when the descending water flow is formed by the rotation of the blade 170, as the laundry is moved toward the pillar 150 and descends, the laundry existing at the lower portion of the drum 30 may move toward the inner circumferential surface of the drum 30 by a load of the laundry descending from the upper portion. In one example, referring to FIG. 11, in one embodiment of the present disclosure, said one surface 177 of the blade 170 may be connected while forming a curvature with respect to the outer circumferential surface 162 of the pillar 150. In addition, the other surface 179 of the blade 170 may also be connected while forming a curvature with respect to the outer circumferential surface 162 of the pillar 150.

In one embodiment of the present disclosure, as said one surface 177 and the other surface 179 of the blade 170 are connected to the outer circumferential surface 162 of the pillar 150 while respectively forming the curvatures, fluidity of water flowing along said one surface 177 and the other surface 179 of the blade 170 may be improved and the resistance by the water may be reduced when the pillar 105 is rotated.

In addition, as shown in FIG. 11, in one embodiment of the present disclosure, a curvature R1 of said one surface 177 of the blade 170 with respect to the outer circumferential surface 162 of the pillar 150 may be smaller than a curvature R2 of the other surface 179 of the blade 170.

That is, the curvature R2 formed by the other surface 179 of the blade 170 with respect to the outer circumferential surface 162 of the pillar 150 may be greater than the curvature R1 formed by said one surface 177 of the blade 170. Accordingly, water resistance and fluidity with respect to the other surface 179 of the blade 170 that forms the acute angle with respect to the outer circumferential surface 162 of the pillar 150 may be effectively improved.

Figure 12:
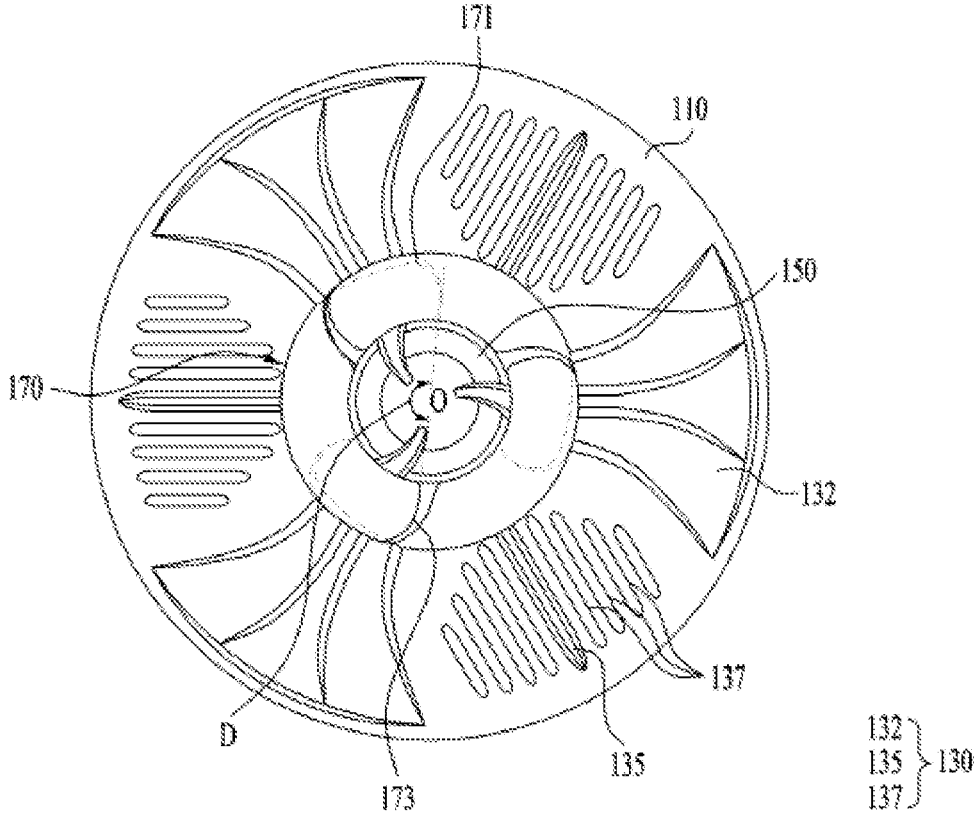
FIG. 12 is a top view of a rotator in a laundry treating apparatus according to an embodiment of the present disclosure.

In one example, FIG. 12 shows a view of the rotator 100 according to an embodiment of the present disclosure viewed from the open surface 31. When the top surface of the drum 30 corresponds to the open surface 31 and the pillar 150 extends in the vertical direction, FIG. 12 may correspond to a front view of the rotator 100.

Referring to FIG. 12, in one embodiment of the present disclosure, the blade 170 extends obliquely with respect to the longitudinal direction L of the pillar 150. In addition, when viewed from the open surface 31, an angle D formed between said one end 171 and the other end 173 with respect to the center O of the pillar 150 may be equal to or larger 144 degrees and equal to or smaller than 216 degrees. For example, the angle D formed by said one end 171 and the other end 173 of the blade may be 170 degrees, 175 degrees, 180 degrees, and the like.

In one embodiment of the present disclosure, the angle D formed between said one end 171 and the other end 173 of the blade 170 with respect to the center O of the pillar 150 may be understood as the number of turns of the blade 170. For example, when the angle D formed by said one end 171 and the other end 173 is 180 degrees, and when the number of turns of the blade 170 corresponds to 0.5, and the angle D formed by said one end 171 and the other end 173 is 360 degrees, the number of turns of blade 170 corresponds to 1.

In one embodiment of the present disclosure, the number of turns of the blade 170 may be equal to or higher than 0.4 and equal to or lower than 0.6. For example, in one embodiment of the present disclosure, the number of turns of blade 170 may be 0.45, 0.5, 0.55, and the like.

In one embodiment of the present disclosure, the number of turns of the blade 170 is equal to or lower than 0.6, so that, even when the plurality of blades 170 are disposed on the outer circumferential surface 162 of the pillar 150 and extend obliquely, it is possible to prevent mutual contact or overlapping of the blades 170.

Figure 28:
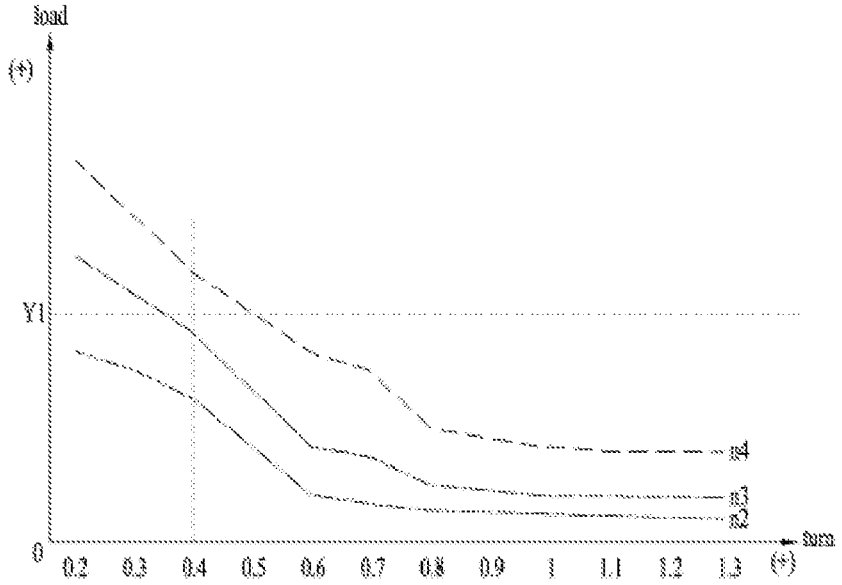
FIG. 28 is a graph showing a driver load based on the number of blades and the number of turns in an embodiment of the present disclosure.

In one example, FIG. 28 shows a graph showing a load of the driver 50 based on the number of turns of the blade 170 in one embodiment of the present disclosure. A horizontal axis of FIG. 28 represents the number of turns of the blade 170, and a vertical axis represents the load of the driver 50. In the graph of FIG. 28, a case of two blades 170 (n2), a case of three blades 170 (n3), and a case of four blades 170 (n4) are indicated separately.

Referring to FIG. 28, as the number of turns of the blade 170 increases, the load on the driver 50 may be reduced. This means that the height of the blade 170 is fixed. An increase in the number of turns in the state in which the height of the blade 170 is fixed may eventually lead to an increase in the inclination angle A of the blade 170.

As described above, when the inclination angle A of the blade 170 increases, the resistance by the water is reduced when the rotator 100 is rotated, so that the load of the driver 50 may be reduced, but the water flow forming force may be reduced, which may adversely affect the washing efficiency.

FIG. 28 shows the allowable load amount Y1 described above. In the case of the three blades 170 (n3), it may be seen that the load of the driver 50 equal to or less than the allowable load amount Y1 is generated when the number of turns of the blade 170 is equal to or higher than 0.4.

Also in the case of the two blades 170 (n2), it may be seen that the load of the driver 50 equal to or less than the allowable load amount Y1 is generated when the number of turns of the blade 170 is 0.4. Even in the case of four blades 170 (n4), the load of the driver 50 equal to or less than the allowable load amount Y1 may be generated with the number of turns of the blade 170 equal to or lower than 0.6.

One embodiment of the present disclosure may be provided with the three blade 170 as shown in FIG. 12. Therefore, in one embodiment of the present disclosure, as the number of turns of the blade 170 is set to be equal to or higher than 0.4 and equal to or lower than 0.6, the load of the driver 50 may be equal to or less than the allowable load amount Y1 considering the damage of the blade 170 or an operating limit of the driver 50.

Figure 29:
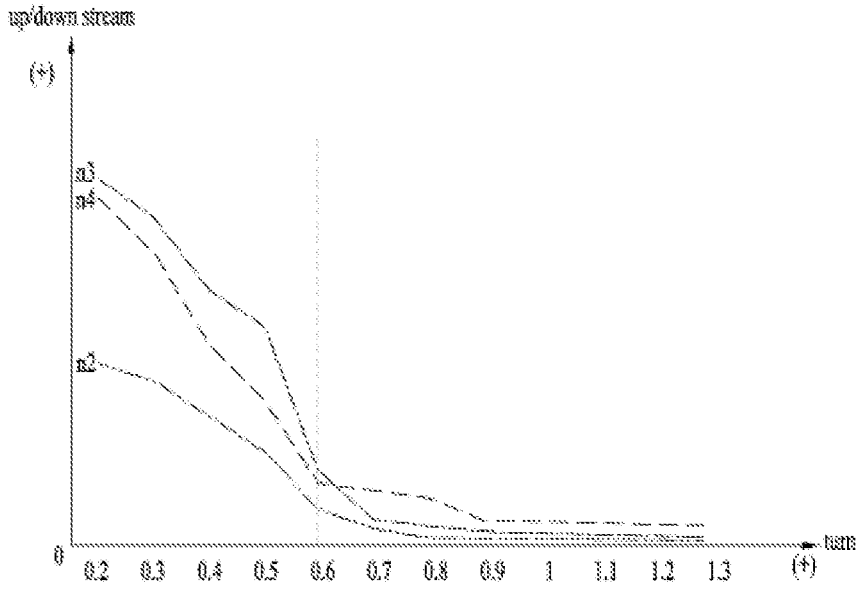
FIG. 29 is a graph showing an ascending and descending water flow formation amount of a rotator based on the number of blades and the number of turns in an embodiment of the present disclosure.

In one example, FIG. 29 shows a graph showing the washing ability of the rotator 100 based on the number of turns of the blade 170 in one embodiment of the present disclosure. A horizontal axis of FIG. 29 represents the number of turns of the blade 170, and a vertical axis represents an ascending and descending water flow formation amount of the rotator 100.

The ascending and descending water flow formation amount of the rotator 100 may have a close relationship with the washing ability of the rotator 100. An ascending and descending water flow includes the ascending water flow and the descending water flow described above. In the washing process, a floating material is put into the drum 30, and an ascending and descending degree of the floating material is observed and quantified.

For example, it may be understood that the greater the number of floating materials identified on the water surface when the ascending water flow is formed by the rotator 100, the greater the ascending water flow formation amount. It may be understood that the smaller the number of floating materials identified on the water surface when the descending water flow is formed, the greater the descending water flow formation amount.

As the ascending and descending water flow includes the ascending water flow and the descending water flow, the ascending and descending water flow formation amount may be calculated by averaging the ascending water flow formation amount and the descending water flow formation amount. In one example, in the graph of FIG. 29, the case of the two blades 170 (n3), the case of the three blades 170 (n3), and the case of four blades 170 (n4) are indicated separately.

Referring to FIG. 29, it may be seen that the ascending and descending water flow formation amount decreases as the number of turns of the blade 170 increases. However, it may be seen that the ascending and descending water flow formation amount has a low value and has a change amount that is not large when the number of turns of the blade 170 is greater than 0.6.

In other words, in one embodiment of the present disclosure, an ascending and descending water flow formation amount of a valid value may occur with the number of turns of the blade 170 equal to or lower than 0.6. Therefore, one embodiment of the present disclosure may set the number of turns of the blade 170 to be equal to or lower than 0.6 to secure the ascending and descending water flow formation amount of a sufficient value.

In addition, when the number of turns of the blade 170 exceeds 0.6, the gap between the blades 170 is reduced, which may increase a possibility that the laundry is jammed, and it is disadvantageous in terms of space to have the plurality of, such as the three, blades 170. Therefore, by design, contact or overlap between the blades 170 may be induced.

Therefore, one embodiment of the present disclosure makes the angle D formed by said one end 171 and the other end 173 of the blade 170 to be equal to or larger than 144 degrees and equal to or smaller than 216 degrees, that is, makes the number of turns of the blade 170 to be equal to or higher than 0.4 and equal to or lower than 0.6, so that it is possible to effectively reduce the loads of the rotator 100 and the driver 50, secure a design advantage, and effectively secure the water flow formation effect.

FIG. 12 shows that the three blades 170 are spaced apart from each other on the outer circumferential surface 162 of the pillar 150, and the angle D formed by said one end 171 and the other end 173 of the blade 170 is 180 degrees, according to an embodiment of the present disclosure.

In one example, as will be described later, in one embodiment of the present disclosure, the protrusion 130 may be disposed on the bottom portion 110, and the protrusion 130 may include a main protrusion 132 that contributes to the water flow formation. The angle D formed by said one end 171 and the other end 173 of the blade 170 may be determined in consideration of a positional relationship with the main protrusion 132.

For example, when the number of turns of the blade 170 is equal to or higher than 0.6 and the height L2 between said one end 171 and the other end 173 of the blade 170 is increased by maintaining the inclination angle A of the blade 170, said one end 171 of the blade 170 may become too close to the main protrusion 132 of the bottom portion 110, which is unfavorable to the molding of the rotator 100.

As above, in one embodiment of the present disclosure, the angle D formed by said one end 171 and the other end 173 of the blade 170 may be determined in consideration of the positional relationship between the protrusion 130 and the blade 170 of the bottom portion 110.

Figure 13:
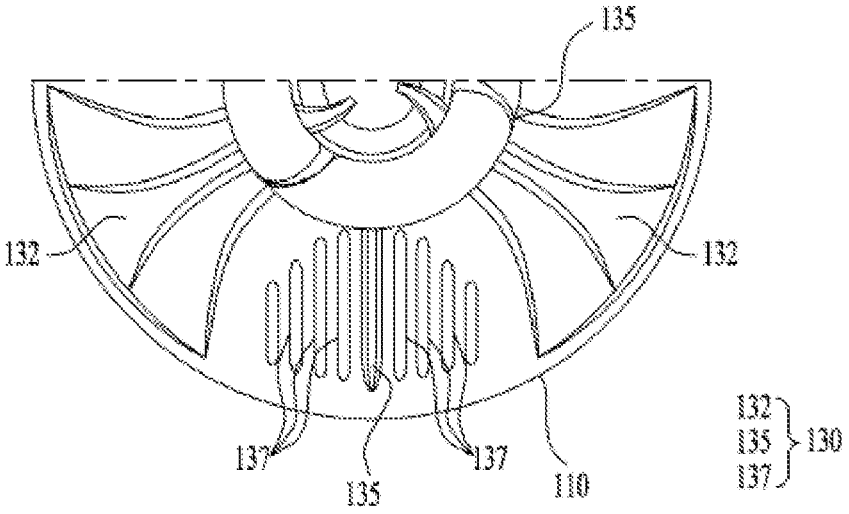
FIG. 13 is a view of a protrusion formed on a bottom portion of a rotator in a laundry treating apparatus according to an embodiment of the present disclosure viewed from the top.

In one example, FIG. 13 shows an enlarged view of the protrusion 130 of the bottom portion 110 shown in FIG. 12.

Referring to FIGS. 12 and 13, the laundry treating apparatus 1 according to an embodiment of the present disclosure may further include the protrusion 130. The protrusion 130 may protrude from the bottom portion 110 toward the open surface 31, extend along a radial direction of the bottom portion 110, and may include a plurality of protrusions spaced apart from each other along the circumferential direction of the bottom portion 110.

The protrusion 130 protrudes from the bottom portion 110 toward the open surface 31, and extends along the radial direction of the bottom portion 110 to form the water flow in the water inside the tub 20 when the bottom portion 110 rotates. That is, in one embodiment of the present disclosure, when the rotator 100 is rotated, the blade 170 of the pillar 150 and the protrusion 130 of the bottom portion 110 may form the water flow together.

The shape of the protrusion 130 may vary. For example, a thickness of the protrusion 130 may be constant or may vary when necessary. A protruding height or an extended length of the protrusion 130 may also be variously determined.

In one embodiment of the present disclosure, as the protrusion 130 of the bottom portion 110 is disposed together with the blade 170 of the pillar 150, the blade 170 and the protrusion 130 form the water flow together, so that the water flow forming effect may be effectively improved. In addition, because the blade 170 and the protrusion 130 cooperatively form the water flow, the washing effect by the water flow may be increased and the shape of the water flow may be improved.

In one example, in one embodiment of the present disclosure, the protrusion 130 may be constructed such that a protruding height thereof from the bottom portion 110 is equal to or smaller than a height of the water S1 corresponding to the minimum water supply amount.

As the protrusion 130 is constructed such that the protruding height thereof from the bottom portion 110, that is, a maximum vertical level of the protrusion 130 is equal to or lower than the vertical level of the water surface S1 corresponding to the minimum water supply amount, like said one end 171 of the blade 170, the protrusion 130 may be constructed to always be submerged in water in the washing process to form the water flow.

As described above, FIG. 5 shows the vertical level of the water surface S1 corresponding to the minimum water supply amount, and the protrusion 130 having the protruding height from the bottom portion 110 equal to or smaller than the height of the water S1 corresponding to the minimum water supply amount.

Figure 14:
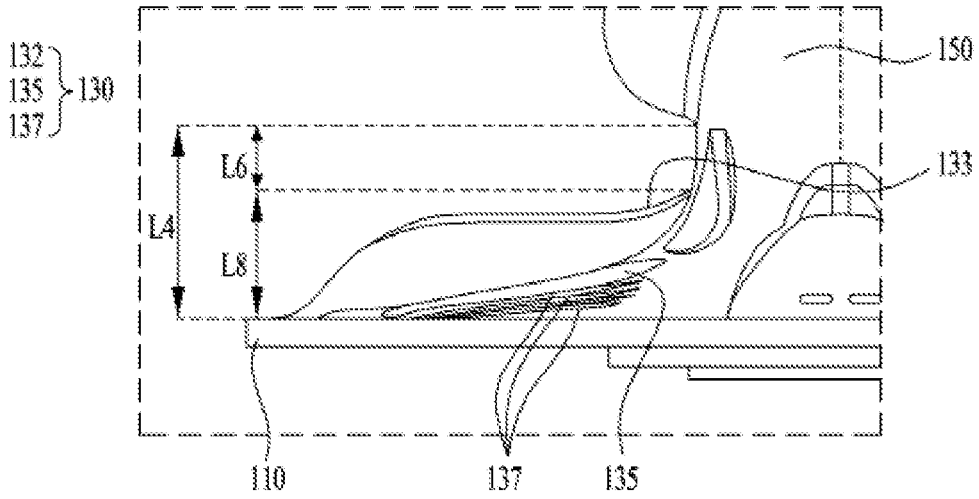
FIG. 14 is a view of a protrusion formed on a bottom portion of a rotator in a laundry treating apparatus according to an embodiment of the present disclosure viewed from the side.

In one example, FIG. 14 shows the protrusion 130 shown in FIG. 13 as viewed from the side, that is, the circumferential direction of the bottom portion 110. Referring to FIGS. 13 and 14, in one embodiment of the present disclosure, at least two of the plurality of protrusions of protrusion 130 may have different protruding heights from the bottom portion 110.

In one embodiment of the present disclosure, as the plurality of protrusions are constructed to have different heights, when the rotator 100 is rotated, the water flow by the protrusion 130 may be generated in a three-dimensional form, thereby effectively improving a washing performance.

In one embodiment of the present disclosure, one of the plurality of protrusions may have a protruding height of a first height, and another may have a protruding height of a second height. The first height may be greater than second height. Therefore, the protrusion of the first height may be advantageous in forming a water flow of a larger scale than the protrusion of the second height. The protrusion of the second height may contribute to stabilizing or maintaining the water flow formed by the protrusion of the first height.

In one embodiment of the present disclosure, in addition to the protrusions of the first height and the second height, the protrusions having various heights may be disposed.

In one example, referring to FIGS. 13 and 14, in one embodiment of the present disclosure, the protrusion 130 may include a main protrusion 132. A plurality of main protrusions 132 may be disposed and may include an inner end 133 facing the pillar 150. The inner end 133 of the main protrusion 132 may be connected to the pillar 150.

The inner end 133 of the main protrusion 132 may face the center of the bottom portion 110. That is, the inner end 133 of the main protrusion 132 may face the pillar 150. An outer end of the main protrusion 132 may face a circumferential side of the bottom portion 110. That is, the outer end of the main protrusion 132 may face the opposite side of the inner end 133.

The plurality of protrusions may include protrusions having different characteristics. The inner end 133 of the main protrusion 132 among the plurality of protrusions may be connected to the pillar 150. The main protrusion 132 may be integrally molded with the bottom portion 110 or may be separately manufactured and coupled thereto. The inner end 133 of the main protrusion 132 may be integrally formed with the pillar 150 or manufactured separately and coupled and connected to the pillar 150.

FIGS. 13 and 14 show the main protrusion 132 integrally molded with the bottom portion 110 according to an embodiment of the present disclosure, and connected to the pillar 150 as the inner end 133 thereof is integrally molded with the pillar 150.

The main protrusion 132 may contribute to the formation of the water flow the most among the plurality of protrusions when the bottom portion 110 rotates. For example, the main protrusion 132 may be constructed such that a protruding height L8 thereof from the bottom portion 110, which is the first height, is the greatest among the protruding heights of the plurality of protrusions, and the inner end 133 and the pillar 150 are connected to each other, so that the main protrusion 132 may contribute to the formation of the water flow the most.

In one example, in one embodiment of the present disclosure, the main protrusion 132 may have the protruding height L8 from the bottom portion 110 equal to or smaller than the height of the water S1 corresponding to the minimum water supply amount. The main protrusion 132 may have the protruding height L8 of the first height, which is the greatest among the protruding heights of the plurality of protrusions. The main protrusion 132 may be constructed such that the protruding height L8 thereof is equal to or smaller than the height of the water S1 corresponding to the minimum water supply amount, so that the main protrusion 132 may always be submerged in the washing process.

In one embodiment of the present disclosure, the protruding height L8 of the main protrusion 132 may vary. For example, the protruding height L8 of the main protrusion 132 may be equal to or greater than 10 mm and equal to or smaller than 100 mm. The protruding height L8 of the main protrusion 132 may be equal to or greater than 30 mm and equal to or smaller than 90 mm. The protruding height L8 of the main protrusion 132 may be equal to or greater than 50 mm and equal to or smaller than 80 mm.

For example, the protruding height L8 of the main protrusion 132 may be equal to or greater than 60 mm and equal to or smaller than 70 mm. The protruding height L8 of the main protrusion 132 may be 63 mm. The protruding height L8 of the main protrusion 132 corresponds to an example for helping the description and understanding of the present disclosure, and does not limit the present disclosure, and may allow for normal errors that may occur during manufacturing.

In one example, as shown in FIGS. 13 and 14, in one embodiment of the present disclosure, the protrusion 130 may further include a first sub-protrusion 135. There may be a plurality of first sub-protrusions 135, and each first sub-protrusion 135 may be disposed between a pair of main protrusions 132. A protruding height from the bottom portion 110 of the first sub-protrusion 135 may be smaller than that of the main protrusion 132.

The main protrusion 132 may extend from the pillar 150 to a circumference of the bottom portion 110, and the first sub-protrusion 135 may have a smaller extended length than the main protrusion 132. A protruding height of the first sub-protrusion 135 may be smaller than the protruding height L8 of the main protrusion 132.

For example, the protruding height of the first sub-protrusion 135 may correspond to the second height, the main protrusion 132 may have the protruding height L8 corresponding to the first height, and the second height may correspond to a height smaller than the first height.

The first sub-protrusion 135 may be disposed between the two main protrusions 132. The number of the main protrusions 132 and the number of first sub-protrusions 135 may be variously designed as needed. The number of the main protrusions 132 may correspond to the number of the blades 170.

For reference, FIG. 12 shows the rotator 100 having the three blades 170, having the three main protrusions 132, and having each first sub-protrusion 135 between a pair of main protrusions 132, which is a total of three first sub-protrusions 135, according to an embodiment of the present disclosure.

In one embodiment of the present disclosure, as the number of the protrusions disposed on the bottom portion 110 increases, it may be advantageous to form the water flow. However, when the plurality of protrusions are made of only the main protrusions 132, the number of the main protrusions 132 may be limited by a size of the main protrusions 132. As a distance between the main protrusions 132 becomes smaller, a space between the main protrusions 132 may not affect the water flow formation and may adversely affect an increase in a washing ability, such as forming an unnecessary vortex.

In one embodiment of the present disclosure, as the first sub-protrusion 135 rather than the main protrusion 132 is disposed between the pair of main protrusions 132, the space between the pair of main protrusions 132 may be sufficiently secured. In the space between the pair of main protrusions 132, the first sub-protrusion 135 flows the water, which is advantageous for the formation of the water flow.

Shapes of the main protrusion 132 and the first sub-protrusion 135 may vary when need. FIG. 13 shows a state in which the main protrusion 132 has a streamline-shaped side surface, and the first sub-protrusion 135 is formed in a rib shape according to an embodiment of the present disclosure.

The main protrusion 132 may be constructed such that a width thereof in the circumferential direction of the bottom portion 110 increases from the inner end 133 toward the outer end, and an increase rate of the width may increase toward the outer end.

That is, the main protrusion 132 may have a shape of a whale tail that increases in width toward the circumference of the bottom portion 110 and have a side surface forming a concave curved surface. The main protrusion 132 having the whale tail shape may reduce resistance by water when the bottom portion 110 rotates, and may improve fluidity of water. Because the water flow flowing by the main protrusion 132 may flow to said one end 171 of the blade 170, it may be advantageous to form the water flow.

The first sub-protrusion 135 may be formed in a shape of a rib extending from the pillar 150 to the circumference of the bottom portion 110. However, the shapes of the main protrusion 132 and the first sub-protrusion 135 are not necessarily limited as described above, and may be variously designed as needed.

In one example, as shown in FIGS. 13 and 14, in one embodiment of the present disclosure, the protrusion 130 may further include a second sub-protrusion 137. The second sub-protrusion 137 may be disposed between the main protrusion 132 and the first sub-protrusion 135, and a protruding height from the bottom portion 110 of the second sub-protrusion 137 may be smaller than that of the first sub-protrusion 135.

The second sub-protrusion 137 may be disposed between one main protrusion 132 and one first sub-protrusion 135 positioned adjacent to said one main protrusion 132. That is, the second sub-protrusion 137 may be disposed between the main protrusion 132 and the first sub-protrusion 135.

The second sub-protrusion 137 may be integrally formed with the bottom portion 110 or manufactured separately and coupled to the bottom portion 110. FIGS. 13 and 14 show the second sub-protrusion 137 integrally formed with the bottom portion 110 according to an embodiment of the present disclosure.

The second sub-protrusion 137 may have a smaller protruding height than the first sub-protrusion 135. For example, in one embodiment of the present disclosure, the protruding height L8 of the main protrusion 132 may correspond to the first height, the protruding height of the first sub-protrusion 135 may correspond to the second height smaller than the first height, and the protruding height of the second sub-protrusion 137 may correspond to a third height smaller than the second height.

That is, in one embodiment of the present disclosure, the plurality of protrusions may have the main protrusion 132, the first sub-protrusion 135, and the second sub-protrusion 137 having the different heights. Accordingly, the water flow by the bottom portion 110 may be formed three-dimensionally and effectively.

In one example, referring to FIG. 13, in one embodiment of the present disclosure, a plurality of second sub-protrusions 137 may be disposed between the main protrusion 132 and the first sub-protrusion 135, and an extended length thereof may increase as being closer to the first sub-protrusion 135.

The number of the second sub-protrusions 137 disposed between one main protrusion 132 and one first sub-protrusion 135 may be variously determined as needed. FIG. 13 shows a state in which four second sub-protrusions 137 are disposed between each main protrusion 132 and each first sub-protrusion 135 according to an embodiment of the present disclosure.

Lengths of the plurality of second sub-protrusions 137 disposed between one main protrusion 132 and one first sub-protrusion 135 may increase in a direction toward the first sub-protrusion 135 and decrease in a direction toward the main protrusion 132.

Accordingly, the plurality of second sub-protrusions 137 may continuously complement the flow of water between the main protrusion 132 and the first sub-protrusion 135 to improve fluidity.

The second sub-protrusion 137 may have an extending direction parallel to the first sub-protrusion 135. Accordingly, an inner end of one of the plurality of second sub-protrusions 137 located far from the first sub-protrusion 135 may not face the pillar 150.

The second sub-protrusions 137 may be disposed together with the first sub-protrusion 135 to improve the fluidity of water between the main protrusions 132.

In one example, in one embodiment of the present disclosure, the protrusion 130, for example, the main protrusion 132, the first sub-protrusion 135, and the second sub-protrusion 137 may contribute to improving flatness of the bottom portion 110.

In one embodiment of the present disclosure, the rotator 100 may be manufactured by injection molding, and a manufacturing process thereof may be completed through out-of-mold cooling after the rotator 100 is taken out from a molding apparatus.

In the out-of-mold cooling process, deformation, such as shrinkage, of the bottom portion 110 may occur because of the cooling. The protrusion 130 disposed on the bottom portion 110 may contribute to suppressing the deformation of the bottom portion 110. Therefore, the protrusion 130 may contribute to the improvement of the flatness of the bottom portion 110.

In addition, the bottom portion 110 may have a space defined therein, and the space may be opened toward the bottom surface 33 of the drum 30. A plurality of reinforcing portions protruding toward the bottom surface 33 of the drum 30 and extending in the circumferential direction or the radial direction of the bottom portion 110 may be disposed in the space of the bottom portion 110.

The reinforcing portion may contribute not only to securing the rigidity of the bottom portion 110 in which the space is defined, but also to suppressing the deformation of the bottom portion 110 that may occur in the out-of-mold cooling process.

Figure 15:
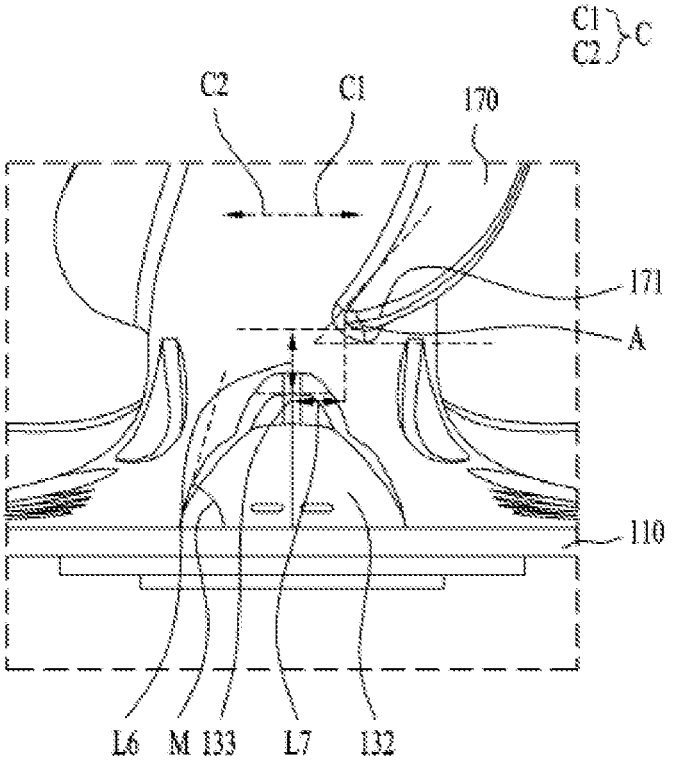
FIG. 15 is a view showing a state in which a protrusion and a blade of a rotator are spaced apart from each other in a laundry treating apparatus according to an embodiment of the present disclosure.

In one example, FIG. 15 shows a positional relationship between the inner end 133 of the main protrusion 132 and said one end 171 of the blade 170. In one embodiment of the present disclosure, said one end 171 of the blade 170 facing toward the bottom portion 110 may be positioned to be spaced apart from the main protrusion 132 along the longitudinal direction L of the pillar 150. That is, said one end 171 of the blade 170 may be spaced apart from the inner end 133 of the main protrusion 132 based on the longitudinal direction L of the pillar 150.

In one embodiment of the present disclosure, when the pillar 150 extends in the vertical direction, it may be understood that said one end 171 of the blade 170 is spaced upwardly apart from the protrusion 130.

As the inner end 133 of the main protrusion 132 and said one end 171 of the blade 170 have a spaced distance L6 therebetween along the longitudinal direction L of the pillar 150, a passage region of water may be defined between the inner end 133 of the main protrusion 132 and said one end 171 of the blade 170.

The passage region of the water corresponds to a region through which the water from which the direct flow is not formed by the blade 170 and the protrusion 130 passes. Accordingly, in the rotator 100, a portion of water passes the region between the blade 170 and the protrusion 130, so that the resistance of water may be reduced.

The passage region may correspond to a connection portion of the pillar 150 and the bottom portion 110. The connection portion may need to be designed to reduce a possibility of breakage in consideration of a connection relationship between the pillar 150 and the bottom portion 110, and may correspond to a portion disadvantageous for integrally molding the blade 170 and the protrusion 130 with the pillar 150 and the bottom portion 110.

Figure 30:
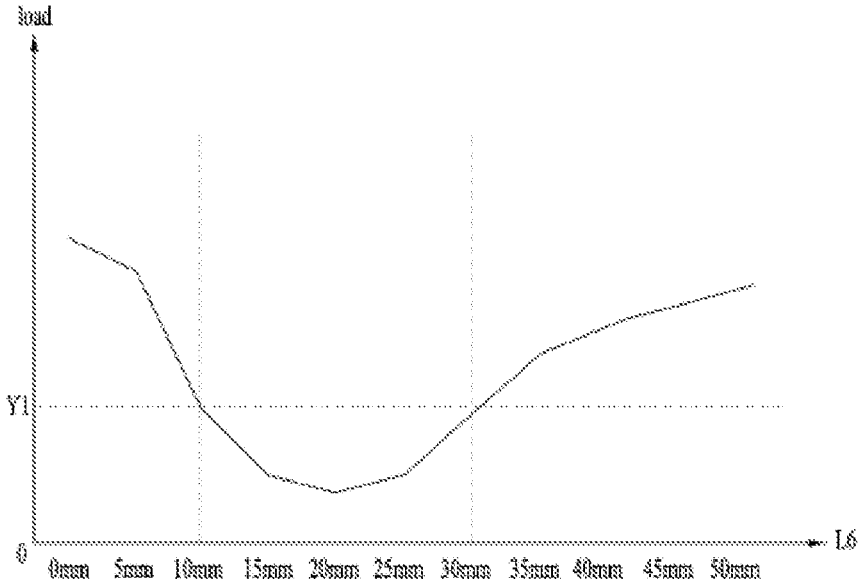
FIG. 30 shows a graph showing a load of a driver based on a vertical distance between a main protrusion and a blade in an embodiment of the present disclosure.

Accordingly, in one embodiment of the present disclosure, as the inner end 133 of the main protrusion 132 and said one end 171 of the blade 170 are spaced apart from each other along the longitudinal direction L of the pillar 150, there may be an advantage in manufacturing, and it may be advantageous in forming the water flow by effectively reducing the resistance of the water. FIG. 30 shows a graph showing a load of the driver 50 based on the spaced distance L6 between the main protrusion 132 and said one end 171 of the blade 170 in one embodiment of the present disclosure. In the graph of FIG. 30, a horizontal axis represents the vertical spaced distance L6 between the main protrusion 132 and said one end 171 of the blade 170, and a vertical axis represents the load of the driver 50.

The graph of FIG. 30 is a result of measuring the load of the driver 50 by increasing the spaced distance L6 between the blade 170 and the main protrusion 132 while maintaining the height L2 between said one end 171 and the other end 173 of the blade 170.

In one embodiment of the present disclosure, the spaced distance L6 between the main protrusion 132 and said one end 171 of the blade 170 along the longitudinal direction L of the pillar 150 may correspond to a height of the passage region of the water. Referring to FIG. 30, it may be seen that the load of the driver 50 gradually decreases and then increases again as the spaced distance L6 of the blade 170 increases.

The behavior of reduction of the load of the driver 50 based on the increase in the spaced distance L6 of the blade 170 may be understood to be affected by the passage region of water described above. The increase in the load of the driver 50 again after the region in which the load of the driver 50 is reduced may be understood to be affected by a structure of the blade 170 that is disadvantageous to the rotation as the blade 170 gradually moves away from the bottom portion 110, and by gradual decrease in the effect of forming the water flow of the main protrusion 132 and the blade 170 in association with each other.

In FIG. 30, the allowable load amount Y1 described above is indicated. One embodiment of the present disclosure may space the main protrusion 132 and the blade 170 apart from each other by selecting an optimal range in which the load of the driver 50 less than the allowable load amount Y1 is generated.

That is, in one embodiment of the present disclosure, as the main protrusion 132 and the blade 170 have the vertical spaced distance L6 equal to or greater than 10 mm and equal to or smaller than 30 mm, the amount of the load of the driver 50 may be set to be equal to or less than the allowable load amount Y1. For example, the spaced distance L6 of the blade 170 may be 15 mm, 20 mm, 22 mm, 25 mm, 30 mm, or the like.

However, the above numerical value is only an example for describing one embodiment of the present disclosure, and the present disclosure is not necessarily limited to the above numerical value. The numerical values should have to allow for a normal error range that may occur during manufacturing.

In one example, referring to FIG. 15, in one embodiment of the present disclosure, the length L8 of the inner end 133 of the main protrusion 132 protruding from the bottom portion 110 may be greater than the upward spaced distance L6 of said one end 171 of the blade 170 from the inner end 133 of the main protrusion 132.

That is, in one embodiment of the present disclosure, based on the longitudinal direction L of the pillar 150, the spaced distance or height L6 between the inner end 133 of the main protrusion 132 and said one end 171 of the blade 170 may be smaller than the protruding length or height L8 of the inner end 133 of the main protrusion 132 from the bottom portion 110.

When the spaced distance L6 between the inner end 133 of the main protrusion 132 and said one end 171 of the blade 170 increases, it may be advantageous for reducing the resistance of water and improving the durability of the rotator 100, but it is disadvantageous for forming the water flow. So that a limit may be needed for the spaced distance L6 between the inner end 133 of the main protrusion 132 and said one end 171 of the blade 170.

In addition, as seen in the graph shown in FIG. 30 above, the increase in the spaced distance L6 between the inner end 133 of the main protrusion 132 and said one end 171 of the blade 170 may rather increase the load of the driver 50 starting from a certain level.

In one example, in one embodiment of the present disclosure, because the protruding height L8 of the main protrusion 132 may correspond to a region in which the water flow is formed by the main protrusion 132. Thus, in one embodiment of the present disclosure, as the protruding height L8 of the main protrusion 132 is greater than the spaced height L6 between the inner end 133 of the main protrusion 132 and said one end 171 of the blade 170, the passage region of water may be efficiently defined while securing an ability to form the water flow.

Based on the longitudinal direction L of the pillar 150, the spaced distance L6 between the inner end 133 of the main protrusion 132 and said one end 171 of the blade 170 may be variously determined as needed.

For example, the vertical spaced distance L6 between the inner end 133 of the main protrusion 132 and said one end 171 of the blade 170 may be equal to or greater than 5 mm and equal to or smaller than 60 mm. The spaced distance L6 may be equal to or greater than 10 mm and equal to or smaller than 50 mm. The spaced distance L6 may be equal to or greater than 20 mm and equal to or smaller than 40 mm.

For example, the spaced distance L6 may be equal to or greater than 25 mm and equal to or smaller than 35 mm. The spaced distance L6 may be 27 mm, 32 mm, and the like. The spaced distance L6 corresponds to an example for helping the description and understanding of the present disclosure, and does not limit the present disclosure, and may allow for normal errors that may occur during manufacturing.

In one example, in one embodiment of the present disclosure, the height L4 of the blade 170 may be equal to or greater than 0.1 times the diameter W1 of the drum 30.

As described above, said one end 171 of the blade 170 may be disposed at the vertical level equal to or lower than the vertical level of the water surface S1 corresponding to the minimum water supply amount. However, in order to secure the protruding height L8 of the main protrusion 132 and the spaced distance L6 between the main protrusion 132 and the blade 170 described above, in one embodiment of the present disclosure, the height L4 of the blade 170 may be equal to or greater than 0.1 times the diameter W1 of the drum 30.

That is, as described above, in one embodiment of the present disclosure, the height L4 of the blade 170 may be equal to or greater than 0.1 times and equal to or less than 0.25 times the diameter W1 of the drum 30.

Accordingly, in one embodiment of the present disclosure, while sufficiently securing the protruding height L8 of the main protrusion 132 and also sufficiently securing the spaced distance L6 between the blade 170 and the main protrusion 132, the vertical level L4 of said one end 171 of the blade 170 may be equal to or less than the vertical level of the water surface S1 corresponding to the minimum water supply amount.

The vertical level L4 of said one end 171 of the blade 170 may be variously determined in a specific design by the height L8 of the main protrusion 132, the spaced distance L6 between the main protrusion 132 and the blade 170, the diameter W1 of the drum 30, the minimum water supply amount, and the like.

In one example, when referring to FIG. 15, in the laundry treating apparatus 1 according to an embodiment of the present disclosure, said one end 171 of the blade 170 may be disposed at a position spaced apart from the main protrusion 132 in said one direction C1 among the circumferential directions C of the pillar 150.

That is, when the blade 170 extends from said one end 171 to the other end 173, the blade 170 may extend obliquely toward said one direction C1 among the circumferential directions C of the pillar 150, and said one end 171 of the blade 170 may have a spaced distance L7 in said one direction C1 from the inner end 133 of the main protrusion 132.

The main protrusion 132 and the blade 170 may form the water flow in association with each other. When said one end 171 of the blade 170 is positioned vertically above the inner end 133 of the main protrusion 132, the water flowing by the main protrusion 132 may flow while passing said one end 171 of the blade 170 when the rotator 100 rotates. This may lead to the formation of unnecessary turbulent water flow, which may be disadvantageous in a relationship with the blade 170.

In addition, the main protrusion 132 and the blade 170 may be spaced apart from each other in the longitudinal direction L of the pillar 150 to define the passage region of water therebetween. When said one end 171 of the blade 170 is located vertically above the main protrusion 132, the effect of the blade 170 on the water passing between the blade 170 and the main protrusion 132 is increased, so that the effect of reducing the resistance of water may be reduced.

Therefore, in one embodiment of the present disclosure, as said one end 171 of the blade 170 is disposed to be spaced apart from the inner end 133 of the main protrusion 132 in said one direction C1, the water flow formed by the main protrusion 132 may continuously reach said one end 171 of the blade 170 and the effect of reducing water resistance may be improved.

In one example, in one embodiment of the present disclosure, said one end 171 of the blade 170 may have the spaced distance L6 along the longitudinal direction L of the pillar 150 from the main protrusion 132 greater than the spaced distance L7 along said one direction C1.

Because the water flow formed by the main protrusion 132 has a strong ascending force on a side of the bottom portion 110, one embodiment of the present disclosure may improve continuity of the water flow and secure the sufficient passage region of water by allowing the spaced distance L6 between the main protrusion 132 and the blade 170 along the longitudinal direction L of the pillar 150 to be greater than the spaced distance L7 between the main protrusion 132 and the blade 170 along the circumferential direction C of the pillar 150.

Figure 31:
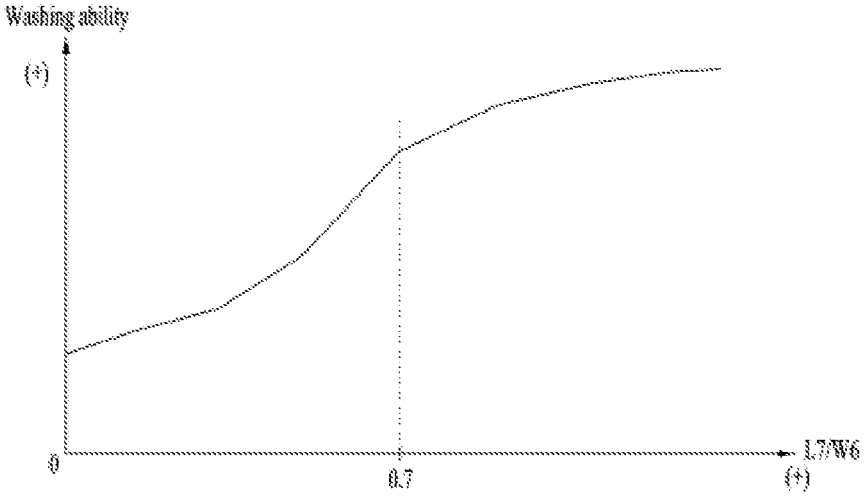
FIG. 31 is a graph showing a washing ability of a rotator based on a horizontal distance with respect to a vertical distance between a main protrusion and a blade in an embodiment of the present disclosure.

FIG. 31 shows a graph showing a ratio of the spaced distance L7 between the main protrusion 132 and the blade 170 along the circumferential direction C of the pillar 150 to the spaced distance L6 between the main protrusion 132 and the blade 170 along the longitudinal direction L of the pillar 150 in one embodiment of the present disclosure and the washing ability.

Hereinafter, for convenience of description, the spaced distance between the main protrusion 132 and the blade 170 along the longitudinal direction L of the pillar 150 will be referred to as the vertical spaced distance L6 of the blade 170, and the spaced distance between the main protrusion 132 and the blade 170 along the circumferential direction C of the pillar 150 will be referred to as the horizontal spaced distance L7 of the blade 170. However, this is only for convenience of description and does not limit the longitudinal direction L of the pillar 150 to the vertical direction or the circumferential direction C of the pillar 150 to the horizontal direction.

The graph of FIG. 31 is a result of measuring the washing ability of the rotator 100 by changing the horizontal spaced distance L7 of the blade 170 while maintaining the vertical spaced distance L6 of the blade 170 at a predetermined distance.

Referring to FIG. 31, it may be seen that the washing ability increases as the horizontal spaced distance L7 increases with respect to the constant vertical spaced distance L6. However, in a region of the horizontal spaced distance L7 out of a range of the horizontal axis in FIG. 31, the washing ability may be decreased along with the increase of the horizontal spaced distance L7.

It may be identified that an increase rate of the washing ability with respect to the increase of the horizontal spaced distance L7 is relatively high when the ratio of the horizontal spaced distance L7 to the vertical spaced distance L6 is equal to or lower than 1, and it may be identified that the increase rate of the washing ability is greatly reduced when the ratio of the horizontal spaced distance L7 to the vertical spaced distance L6 is equal to or higher than 1.

That is, when the ratio of the horizontal spaced distance L7 to the vertical spaced distance L6 is equal to or lower than 1, as the horizontal spaced distance L7 increases, the washing ability may be effectively increased. Therefore, in one embodiment of the present disclosure, it is advantageous in terms of efficiency for securing the washing ability that the vertical spaced distance L6 has a larger value than the horizontal spaced distance L7.

Further, in one embodiment of the present disclosure, the increase in the horizontal spaced distance L7 may create a design constraint between the plurality of blades 170 and the plurality of main protrusions 132. For example, when the horizontal spaced distance L7 of the blade 170 is increased, a restriction on the mold for molding the rotator 100 may be created, which may be disadvantageous in the manufacturing.

Therefore, in one embodiment of the present disclosure, the rotator 100 is constructed such that the spaced distance L6 between the inner end 133 of the main protrusion 132 and said one end 171 of the blade 170 based on the longitudinal direction L of the pillar 150 is greater than the spaced distance L7 between the inner end 133 of the main protrusion 132 and said one end 171 of the blade 170 based on the circumferential direction C of the pillar 150, thereby effectively improving the washing ability.

The spaced distance L7 between the main protrusion 132 and the blade 170 based on the circumferential direction C of the pillar 150 may be determined by specifically considering various factors such as the thickness and the protruding height of the main protrusion 132, the number of turns of the blade 170, and the like.

For example, in one embodiment of the present disclosure, the spaced distance L7 between the main protrusion 132 and the blade 170 along the circumferential direction C of the pillar 150 may be equal to or greater than 5 mm and equal to or smaller than 50 mm. The spaced distance L7 may be equal to or greater than 10 mm and equal to or smaller than 40 mm. The spaced distance L7 may be equal to or greater than 15 mm and equal to or smaller than 30 mm.

For example, the spaced distance L7 may be equal to or greater than 20 mm and equal to or smaller than 25 mm. The spaced distance L7 may be 20, 21, 22 mm, or the like. The spaced distance L7 corresponds to an example for helping the description and understanding of the present disclosure, and does not limit the present disclosure, and may allow for normal errors that may occur during manufacturing.

In one example, FIG. 15 shows an inclination angle M between a side surface of the main protrusion 132 and the bottom portion 110, and the inclination angle A of the blade 170. Referring to FIG. 15, in one embodiment of the present disclosure, the inclination angle M formed by the side surface of the main protrusion 132 with respect to the circumferential direction C of the pillar 150 may be greater than the inclination angle A of the blade 170.

As described above, when the rotator 100 is rotated, the water around the bottom portion 110 ascends by the main protrusion 132, and the water ascended by the main protrusion 132 is provided to said one end 171 of the blade 170, so that the water flow may be formed. That is, when the rotator 100 rotates, the water flow may be continuously formed by the side surface of the main protrusion 132 and the blade 170.

The side surface of the main protrusion 132 may form the inclination angle M with respect to the bottom portion 110, and the water on the side of the bottom portion 110 may be flowed by the side surface of the main protrusion 132 and ascend when the rotator 100 rotates.

In one example, the water ascending by the main protrusion 132 may form the ascending water flow and the like by the blade 170, and the flow of water may decrease in the ascending force in the process of reaching the blade 170 after ascending by the main protrusion 132, so that it is advantageous that the inclination angle M of the side surface of the main protrusion 132 is greater than the inclination angle A of the blade 170 in order for the water flow that reaches the blade 170 through the main protrusion 132 to maintain the continuity.

Therefore, in one embodiment of the present disclosure, the inclination angle M formed by the side surface of the main protrusion 132 with respect to the circumferential direction C of the pillar 150 is greater than the inclination angle A of the blade 170, thereby increasing the ascending effect of the water by the main protrusion 132 and effectively maintaining the continuity of the water flow flowing from the main protrusion 132 to the blade 170.

Figure 16:
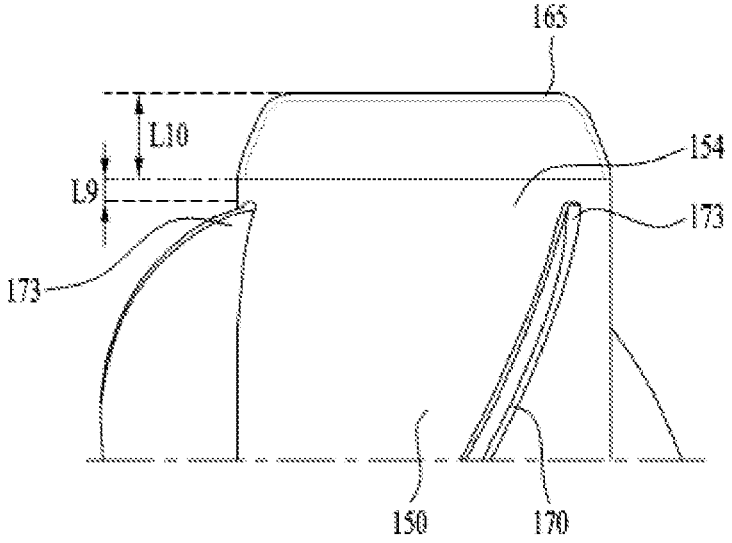
FIG. 16 is a view showing a cap coupled to a pillar in a laundry treating apparatus according to an embodiment of the present disclosure.
Figure 18:
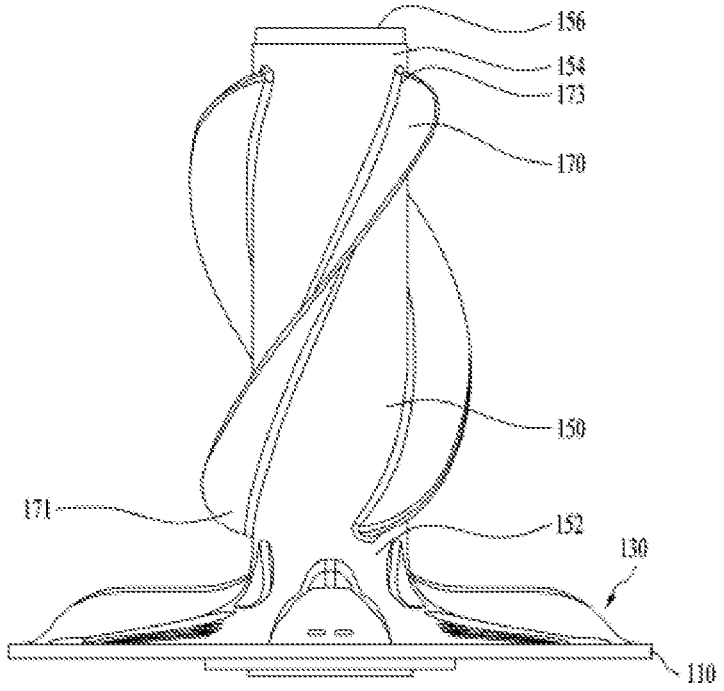
FIG. 18 is a view showing a rotator from which a cap is separated in a laundry treating apparatus according to an embodiment of the present disclosure.
Figure 19:
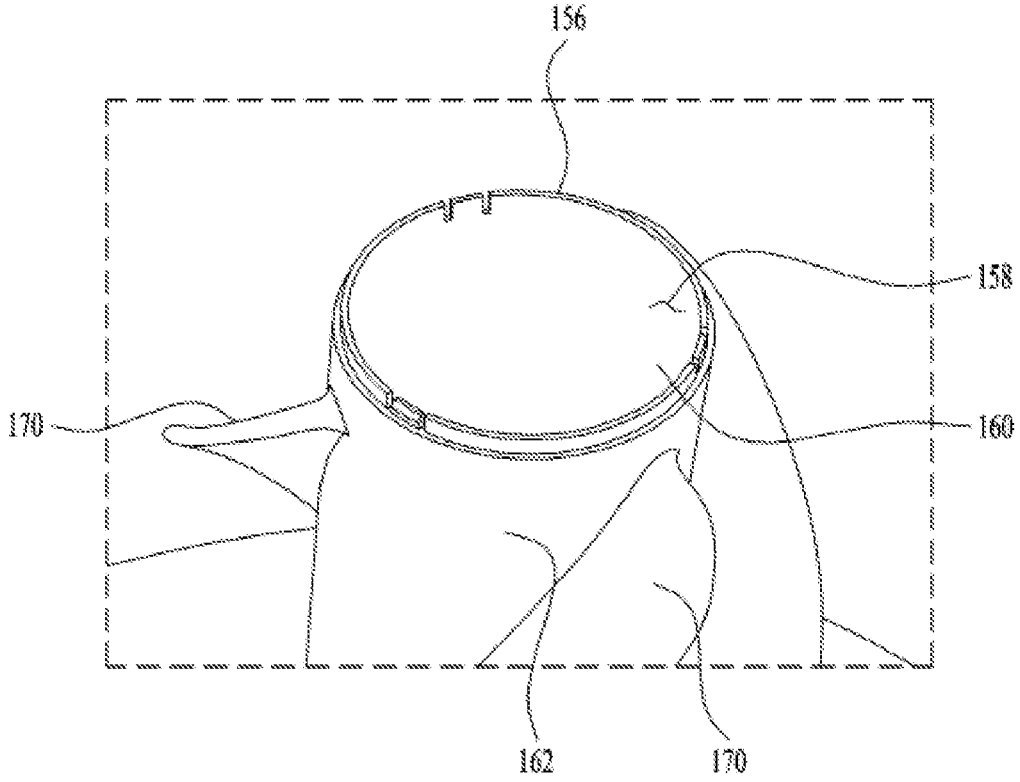
FIG. 19 is a view showing a cap-coupled-portion of a pillar in a laundry treating apparatus according to an embodiment of the present disclosure.

In one example, FIG. 16 shows a state in which a cap 165 is disposed at an end of the pillar 150 facing toward the open surface 31 according to an embodiment of the present disclosure, FIG. 18 shows the pillar 150 from which the cap 165 is separated, and FIG. 19 shows a cap-coupled-portion 156 disposed at the end of the pillar 150.

Referring to FIGS. 16, 18, and 19, in the laundry treating apparatus 1 according to an embodiment of the present disclosure, the pillar 150 may be formed in a hollow shape, and may have an opening 158 in communication with an interior thereof defined at the end facing toward the open surface 31. In addition, the cap 165 coupled to the end to shield the opening 158 may be included.

The pillar 150 may be formed in the hollow shape in which an empty space is defined. Accordingly, it is advantageous that the pillar 150 may be formed through a vertical movement of the mold when molding the pillar 150, the load on the driver 50 may be reduced as a weight of the pillar 150 is reduced, and unnecessary waste of materials may be prevented.

In one example, the opening 158 in communication with the interior of the pillar 150 in the hollow shape may be defined at the end of the pillar 150 facing toward the open surface 31. That is, when the pillar 150 extends in the vertical direction, the opening 158 may be defined at the upper end of the pillar 150.

In order to mold the pillar 150 in the hollow shape, during the molding process of the rotator 100, a solid core-shaped mold for maintaining the shape of the pillar 150 may be inserted into the pillar 150. As such molding process is performed, the opening 158 may be defined at the end of the pillar 150.

The pillar 150 may be formed in a cylindrical shape, and one surface facing toward the open surface 31, for example, a top surface of the pillar 150 may be opened to define the opening 158. However, the specific shape of the pillar 150 may be variously determined as needed.

In one example, the cap 165 may be coupled to the end of the pillar 150 to shield the opening 158. The cap 165 may be formed in various shapes such as a plate shape, a cup shape, or the like, and may be coupled to the end of the pillar 150 to shield the opening 158.

A scheme for coupling the cap 165 and the pillar 150 to each other may be varied. For example, the cap 165 may be coupled to the end of the pillar 150 in various schemes, such as a screw coupling scheme, a hook coupling scheme, or the like.

In one embodiment of the present disclosure, it is possible to secure a molding advantage and secure an advantage in manufacturing and operation of the rotator 100 as the pillar 150 is formed in the hollow shape, and it is possible to effectively prevent an unnecessary situation in which foreign substances are accumulated inside the pillar 150 as the opening 158 of the pillar 150 is shielded by the cap 165.

In one example, referring to FIG. 16, in an embodiment of the present disclosure, the other end 173 of the blade 170 facing toward the open surface 31 may be positioned spaced apart from the cap 165. That is, the other end 173 of the blade 170 may be spaced apart from the cap 165 along the longitudinal direction L of the pillar 150. When the pillar 150 extends in the vertical direction, the other end 173 of the blade 170 may be spaced downward from the cap 165.

The injection molding scheme using the mold may be used in the molding process of the rotator 100, and the pillar 150 and the blade 170 may be integrally molded. In the molding process of the rotator 100, a cooling process of the rotator 100 may be performed, and the cooling process may include an in-mold cooling process and an out-of-mold cooling process.

In one example, when the out-of-mold cooling process is in progress, shrinkage of the pillar 150 and the blade 170 may occur.

In the out-of-mold cooling process, depending on a thickness deviation between the blade 170 and the pillar 150 and a position of the blade 170, a shrinkage amount may vary throughout the other end 154 facing toward the open surface 31 of the drum 30 and/or the cap-coupled-portion 156 of the pillar 150. When the cap-coupled-portion 156 is deformed because of the variation in the shrinkage amount, it may be disadvantageous for the cap 165 to be coupled to the cap-coupled-portion 156.

In one embodiment of the present disclosure, the other end 173 of the blade 170 may be disposed to be spaced apart from the cap 165 so as to suppress the variation in the shrinkage amount and the deformation of the cap-coupled-portion 156 based on presence or absence of the blade 170.

Accordingly, an amount of shrinkage deformation caused by the blade 170 may be reduced at the cap-coupled-portion 156 at which the cap 165 is located. Therefore, it may be easy for the cap 165 to be coupled to the pillar 150, that is, the cap-coupled-portion 156, after the rotator 100 is molded.

Figure 17A:
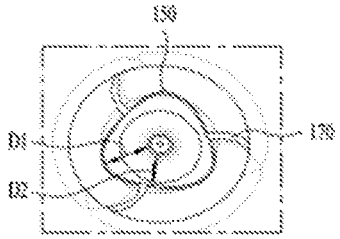
FIGS. 17A to 17C are diagrams showing an amount of deformation based on a spaced distance between a cap and a blade in a laundry treating apparatus according to an embodiment of the present disclosure.
Figure 17B:
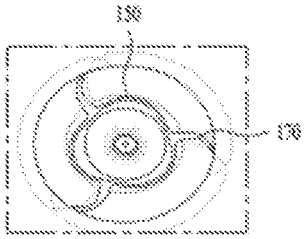
Figure 17C:
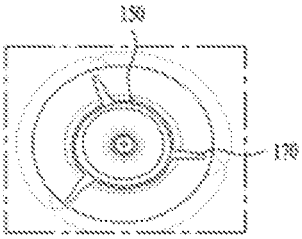

FIGS. 17A to 17C show an amount of deformation of the cap-coupled-portion 156 based on a spaced distance L9 between the cap 165 and the blade 170 in one embodiment of the present disclosure. In FIG. 17A, the spaced distance L9 between the cap 165 and the blade 170 corresponds to a first distance. In FIG. 17B, the spaced distance L9 between the cap 165 and the blade 170 corresponds to a second distance larger than the first distance. In FIG. 17C, the spaced distance L9 between the cap 165 and the blade 170 corresponds to a third distance larger than the second distance.

Referring to FIGS. 17A to 17C, in one embodiment of the present disclosure, as the spaced distance L9 between the blade 170 and the cap 165 increases, the amount of deformation of the cap-coupled-portion 156 decreases. This is because, as described above, the shrinkage amount varies throughout the pillar 150 and the cap-coupled-portion 156 by the presence of the blade 170 in the cooling process, for example, in the out-of-mold cooling process, of the rotator 100.

Furthermore, as a deviation between a thickness Tb of the blade 170 and a thickness Ta of the other end 154 at which the cap-coupled-portion 156 is disposed in the pillar 150 increases, the amount of deformation of the cap-coupled-portion 156 may be increased. This is because the greater the deviation between the thickness Tb of the blade 170 and the thickness Ta of the pillar 150, the greater the deviation in the amount of shrinkage occurred in the cooling process. In consideration of this, the spaced distance L9 between the cap 165 and the blade 170 may be adjusted.

Specifically, in one embodiment of the present disclosure, the spaced distance L9 between the blade 170 and the cap 165 may be equal to or more than twice the deviation amount between the thickness Tb of the blade 170 and the thickness Ta of the pillar 150.

The thickness Tb of the blade 170 means a value measured on the outer circumferential surface of the pillar 150. That is, when the thickness of the blade 170 decreases as the distance from the pillar 150 increases, the thickness Tb of the blade 170 may be the greatest value.

The thickness Ta of the pillar 150 means the thickness Ta of the pillar 150 on which the cap-coupled-portion 156 is located. That is, the thickness Ta of the pillar 150 may be measured on the opening 158 of the pillar 150 and may mean a thickness between the inner circumferential surface and the outer circumferential surface of the pillar 150. For example, when the thickness Ta of the pillar 150 gradually decreases from said one end facing toward the bottom portion toward the other end 154, the thickness Ta of the pillar 150 may be the smallest value.

For reference, FIG. 11 shows the thickness Tb of the blade 170 and the thickness Ta of the pillar 150 for determining the spaced distance L9 between the blade 170 and the cap 165 according to an embodiment of the present disclosure.

Figure 32:
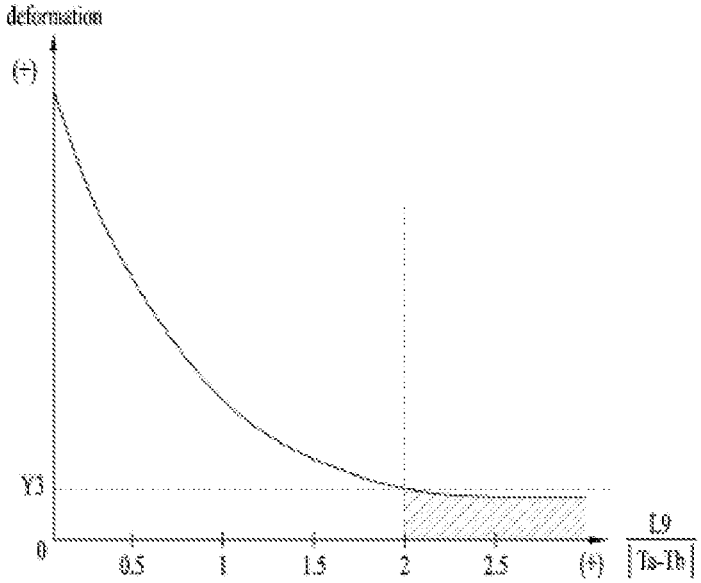
FIG. 32 is a graph showing a relationship between a spaced distance between a cap and a blade and an amount of deformation of a cap-coupled-portion in an embodiment of the present disclosure.

In one example, FIG. 32 is a graph showing a relationship between the spaced distance L9 between the blade 170 and the cap 165 and the amount of deformation of the cap-coupled-portion 156 in one embodiment of the present disclosure. In the graph of FIG. 32, a horizontal axis represents a ratio of the spaced distance L9 between the cap 165 and the blade 170 to the deviation amount between the thickness Tb of the blade 170 and the thickness Ta of the pillar 150, and a vertical axis represents the amount of deformation of the cap-coupled-portion 156.

The deviation amount between the thickness Tb of the blade 170 and the thickness Ta of the pillar 150 is an absolute value, and thus, does not have a negative value. The amount of deformation of the cap-coupled-portion 156 may be calculated through a deviation amount between a distance D1 from a center of the pillar 150 to the farthest point of the cap-coupled-portion 156 and a distance D2 from the center of the pillar 150 to the nearest point of the cap-coupled-portion 156.

For reference, FIG. 17A shows the distance D1 from the center of the pillar 150 to the farthest point of the deformed cap-coupled-portion 156 and the distance D2 from the center of the pillar 150 to the closest point of the deformed cap-coupled-portion 156.

The graph of FIG. 32 is a result of observing the amount of deformation of the cap-coupled-portion 156 after the cooling process while changing the spaced distance L9 between the blade 170 and the cap 165 in a state in which the thickness Tb of the blade 170 and the thickness Ta of the pillar 150 are maintained at constant values.

Referring to FIG. 32, in one embodiment of the present disclosure, it may be seen that the amount of deformation of the cap-coupled-portion 156 is reduced as the spaced distance L9 between the blade 170 and the cap 165 increases. In the graph of FIG. 32, an allowable deformation amount Y3 is indicated. The allowable deformation amount Y3 means a maximum deformation amount within a range in which the cap 165 may be completely coupled to the cap-coupled-portion 156 after the cooling process.

The allowable deformation amount Y3 may be determined in consideration of results of repeated experiments, stability of coupling between the cap 165 and the cap-coupled-portion 156, and the like.

As may be seen in the graph of FIG. 32, when the spaced distance L9 between the cap 165 and the blade 170 is at least twice the thickness deviation amount between the blade 170 and the pillar 150, the deformation amount of the cap-coupled-portion 156 may be equal to or less than the allowable deformation amount Y3.

Therefore, in one embodiment of the present disclosure, as the spaced distance L9 between the cap 165 and the blade 170 is equal to or greater than twice the deviation amount between the thickness Ta of the pillar 150 and the thickness Tb of the blade 170, even when the out-of-mold cooling process is performed and the cap-coupled-portion 156 is deformed, a complete coupling between the cap 165 and the cap-coupled-portion 156 may be achieved.

In one example, referring to FIG. 16, in one embodiment of the present disclosure, the blade 170 may be positioned such that the other end 173 thereof is spaced apart from the cap 165, and the spaced distance L9 between the other end 173 and the cap 165 based on the longitudinal direction L of the pillar 150 may be smaller than a length L10 of the cap 165.

As described above, the other end 173 of the blade 170 may be disposed to be spaced apart from the cap 165 for ease of coupling of the cap 165. However, as the spaced distance L9 between the cap 165 and the other end 173 of the blade 170 increases, a region occupied by the blade 170 in the pillar 150 may be reduced, which may be disadvantageous in improving a contact area between the blade 170 and the water.

Accordingly, one embodiment of the present disclosure may limit the spaced distance L9 between the cap 165 and the blade 170 to be smaller than the length L10 of the cap 165. The spaced distance L9 between the cap 165 and the blade 170 and the length L10 of the cap 165 are to be understood as vertical distances along the longitudinal direction L of the pillar 150 as shown in FIG. 16.

The spaced distance L9 between the cap 165 and the blade 170 and the length L10 of the cap 165 may be specifically determined in consideration of various factors such as the length L1 of the pillar 150, utilization of the cap 165, the thickness of the blade 170, the inclination angle A, or the like.

For example, the spaced distance L9 between the cap 165 and the blade 170 may be equal to or greater than 5 mm and equal to or smaller than 50 mm. The spaced distance L9 may be equal to or greater than 10 mm and equal to or smaller than 40 mm. The spaced distance L9 may be equal to or greater than 15 mm and equal to or smaller than 30 mm.

For example, the spaced distance L9 may be equal to or greater than 20 mm and equal to or smaller than 25 mm. The spaced distance L9 may be 22 mm, 23 mm, or the like. The spaced distance L9 corresponds to an example for helping description and understanding of the present disclosure, and does not limit the present disclosure, and may allow for normal errors that may occur during manufacturing.

In one example, for example, the length L10 of the cap 165 may be equal to or greater than 5 mm and equal to or smaller than 50 mm. The length L10 of the cap 165 may be equal to or greater than 10 mm and equal to or smaller than 45 mm. The length L10 of the cap 165 may be equal to or greater than 15 mm and equal to or smaller than 40 mm.

For example, the length L10 of the cap 165 may be equal to or greater than 25 mm and equal to or smaller than 35 mm. The length L10 of the cap 165 may be 30 mm, 33 mm, 33.5 mm, or the like. The length L10 of the cap 165 described above corresponds to an example for helping description and understanding of the present disclosure, and does not limit the present disclosure, and may allow for normal errors that may occur during manufacturing.

Figure 20:
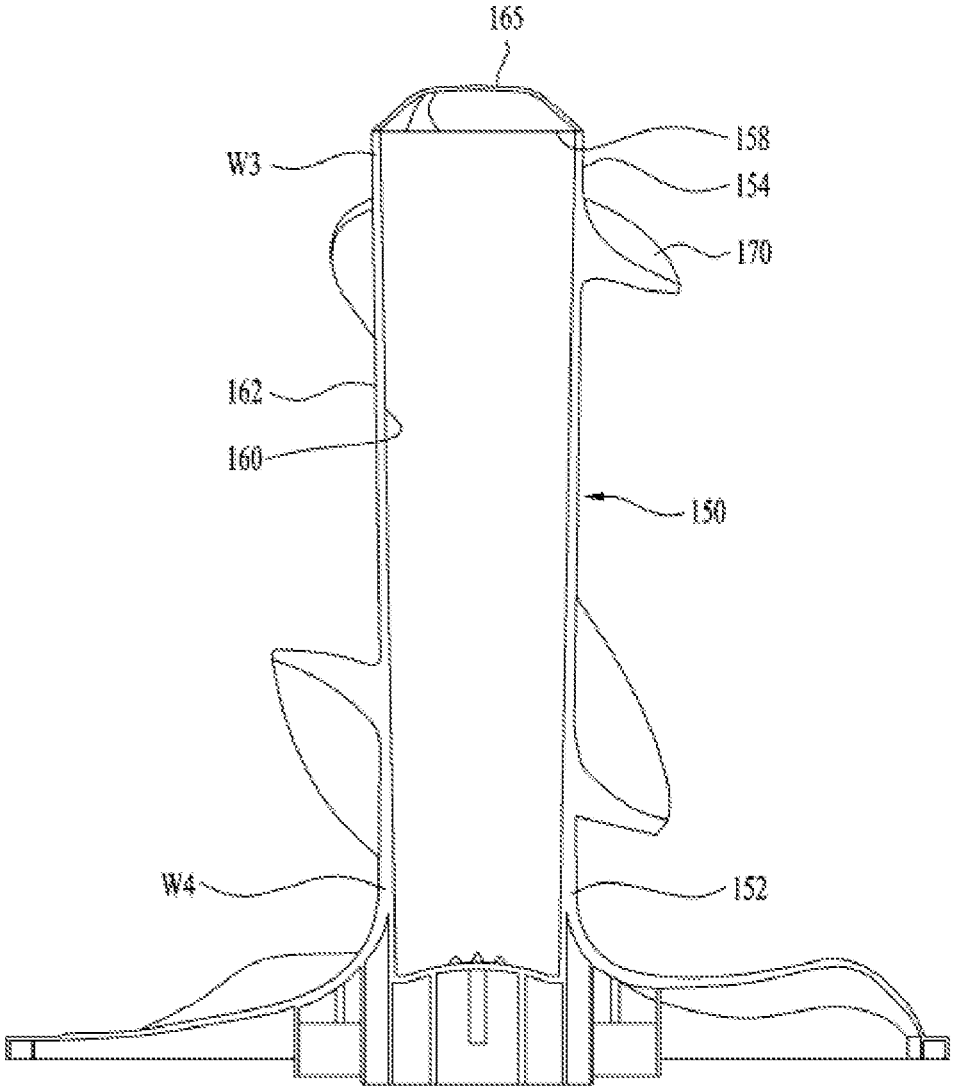
FIG. 20 is a cross-sectional view of a rotator in a laundry treating apparatus viewed in a lateral direction according to an embodiment of the present disclosure.

In one example, FIG. 20 shows a cross-sectional view of the rotator 100 viewed in a lateral direction according to an embodiment of the present disclosure. The lateral direction may be a direction perpendicular to the longitudinal direction L of the pillar 150.

Referring to FIG. 20, in one embodiment of the present disclosure, the pillar 150 may be constructed such that a thickness W4 between the inner circumferential surface 160 and the outer circumferential surface 162 at the end facing toward the bottom portion 110 is greater than a thickness W3 between the inner circumferential surface 160 and the outer circumferential surface 162 at the end facing toward the open surface 31.

The pillar 150 may be formed in the hollow shape, and thus may have the inner circumferential surface 160 surrounding the inner space and the outer circumferential surface 162 exposed to the outside. The thickness of the pillar 150 may be understood as a distance between the inner circumferential surface 160 and the outer circumferential surface 162.

The pillar 150 may include the end facing toward the bottom portion 110 and the end facing toward the open surface 31. The thickness W4 between the inner circumferential surface 160 and the outer circumferential surface 162 at the end facing toward the bottom portion 110 may be greater than the thickness W3 between the inner circumferential surface 160 and the outer circumferential surface 162 at the end facing toward the open surface 31.

As described above, the pillar 150 may be manufactured through injection molding. The pillar 150 manufactured by the injection molding may be advantageous for the blade 170 to be integrally molded. In one example, in the pillar 150 manufactured by the injection molding, the thickness W4 of a lower portion may be greater than the thickness W3 of an upper portion by a load of the material.

In addition, as described above, the connection portion between the pillar 150 and the bottom portion 110 needs to be designed to be strong against breakage. Accordingly, because the pillar 150 is constructed such that the thickness W4 of the lower portion is greater than the thickness W3 of the upper portion, strength of the connection portion may be improved. Accordingly, in one embodiment of the present disclosure, the thickness W4 of the lower portion of the pillar 150 may be greater than the thickness W3 of the upper portion.

Although the present disclosure has been illustrated and described in relation to a specific embodiment, it is understood that the present disclosure may be variously improved and changed within the scope of the technical idea of the present disclosure provided by the following claims. Therefore, the scope of the present disclosure should not be limited to the described embodiment and should be defined by the claims described later as well as the equivalents of the claims.

What is claimed is:

1. A laundry treating apparatus comprising:

a tub configured to receive water;

a drum rotatably disposed inside the tub, the drum having an open surface configured to receive laundry therethrough and a bottom surface located at an opposite side of the open surface; and a rotator rotatably disposed inside the drum, the rotator comprising:

a bottom portion disposed at the bottom surface of the drum, a pillar that protrudes from the bottom portion toward the open surface of the drum, a plurality of main protrusions that protrude from the bottom portion toward the open surface of the drum and extend radially away from the pillar, each of the plurality of main protrusions having an inner end connected to the pillar, and a plurality of blades that are arranged along a circumferential direction of the pillar, wherein each of the plurality of blades protrudes from an outer circumferential surface of the pillar and has a first end facing the bottom portion and a second end facing the open surface of the drum, each of the plurality of blades extending from one of the first ends to a corresponding one of the second ends and being inclined with respect to a longitudinal direction of the pillar, wherein the first end of each of the plurality of blades extends toward the inner end of a corresponding one of the plurality of main protrusions, wherein each of the plurality of main protrusions corresponds to the first end of a corresponding one of the plurality of blades and extends in a radial direction of the bottom portion, and wherein a number of turns of each of the plurality of blades wound around the pillar from the first end to the second end is defined based on a circumference of the pillar viewed from the open surface of the drum, the number of turns being greater than or equal to 0.4 times of the circumference of the pillar and less than or equal to 0.6 times of the circumference of the pillar such that the plurality of blades are spaced apart from one another in the circumferential direction and inclined with respect to the longitudinal direction of the pillar.

2. The laundry treating apparatus of claim 1, wherein each of the plurality of blades continuously extends obliquely with respect to the longitudinal direction of the pillar.

3. The laundry treating apparatus of claim 2, wherein each of the plurality of blades extends with a constant inclination angle with respect to the circumferential direction of the pillar.

4. The laundry treating apparatus of claim 3, wherein the constant inclination angle is greater than or equal to 35 degrees and less than or equal to 65 degrees with respect to the circumferential direction of the pillar.

5. The laundry treating apparatus of claim 2, wherein a height of each of the plurality of blades from the first end to the second end is greater than or equal to 0.5 times of a height of the pillar in the longitudinal direction of the pillar.

6. The laundry treating apparatus of claim 2, wherein each of the plurality of blades extends along an extension direction inclined with respect to the longitudinal direction of the pillar, and wherein an extension length of each of the plurality of blades from the first end to the second end along the extension direction is greater than a height of each of the plurality of blades from the first end to the second end along the longitudinal direction of the pillar, the extension length being greater than or equal to 1.4 times of the height and less than or equal to 1.8 times of the height.

7. The laundry treating apparatus of claim 1, wherein the pillar defines a hollow space therein and an opening at an end of the pillar facing the open surface of the drum, the opening being in communication with the hollow space, and wherein the rotator further comprises a cap that is coupled to the end of the pillar and that covers the opening of the pillar.

8. The laundry treating apparatus of claim 7, wherein the second end of each of the plurality of blades is spaced apart from the cap in the longitudinal direction of the pillar.

9. The laundry treating apparatus of claim 8, wherein a distance between the second end of each of the plurality of blades and the cap is less than a height of the cap in the longitudinal direction of the pillar.

10. The laundry treating apparatus of claim 8, wherein the pillar further comprises a cap-coupled-portion that is coupled to the cap, and wherein a distance between the second end of each of the plurality of blades and the cap is greater than or equal to twice of a difference between a pillar thickness of the pillar and a blade thickness of each of the plurality of blades at the cap-coupled-portion.

11. The laundry treating apparatus of claim 10, wherein the cap-coupled-portion is disposed at the outer circumferential surface of the pillar and connected to an inner end of each of the plurality of blades, the inner end defining the blade thickness.

12. The laundry treating apparatus of claim 11, wherein the blade thickness decreases from the inner end toward an outer end that is radially spaced apart from the inner end.

13. The laundry treating apparatus of claim 1, wherein a diameter of the bottom portion of the rotator is greater than or equal to 0.7 times of a diameter of the drum and less than or equal to 0.9 times of the diameter of the drum.

14. The laundry treating apparatus of claim 1, wherein a length of the pillar in the longitudinal direction is greater than or equal to 0.8 times of a diameter of the bottom portion of the rotator and less than or equal to 1.2 times of the diameter of the bottom portion of the rotator.

15. The laundry treating apparatus of claim 1, wherein the rotator further comprises a plurality of protrusions that protrude from the bottom portion of the rotator toward the open surface of the drum, that are spaced apart from one another in a circumferential direction of the bottom portion, and that extend radially away from the pillar.

16. The laundry treating apparatus of claim 15, wherein the plurality of protrusions comprise a main protrusion among the plurality of main protrusions, and wherein the first end of each of the plurality of blades is spaced apart from the inner end of the main protrusion among the plurality of main protrusions in the longitudinal direction of the pillar.

17. The laundry treating apparatus of claim 16, wherein the first end of each of the plurality of blades is spaced apart from the main protrusion among the plurality of main protrusions in the circumferential direction of the pillar.

18. The laundry treating apparatus of claim 17, wherein a distance between the first end of a blade among the plurality of blades and the main protrusion among the plurality of main protrusions in the longitudinal direction of the pillar is greater than a distance from the main protrusion among the plurality of main protrusions to the first end of the blade along the circumferential direction of the pillar.

19. The laundry treating apparatus of claim 15, wherein the plurality of protrusions comprise:

the plurality of main protrusions spaced apart from one another in the circumferential direction of the bottom portion of the rotator; and a plurality of sub-protrusions disposed between two main protrusions among the plurality of main protrusions and spaced apart from one another in the circumferential direction of the bottom portion of the rotator, and wherein a distance between the first end of a blade among the plurality of blades and a main protrusion among the plurality of main protrusions in the longitudinal direction of the pillar is less than a distance between the first end of the blade and a sub-protrusions among the plurality of sub-protrusions in the longitudinal direction of the pillar.

20. The laundry treating apparatus of claim 1, wherein each of the plurality of blades has:

a first surface that at least partially faces the open surface of the drum and is connected to the outer circumferential surface of the pillar, the first surface defining an obtuse angle with respect to the outer circumferential surface of the pillar; and a second surface that at least partially faces the bottom portion of the rotator, that is connected to the outer circumferential surface of the pillar, and that is disposed at an opposite side of the first surface, the second surface defining an acute angle with respect to the outer circumferential surface of the pillar.

* * * * *